US011357698B2

(12) United States Patent
Baxter et al.

(10) Patent No.: US 11,357,698 B2
(45) Date of Patent: Jun. 14, 2022

(54) SYSTEM, METHOD AND APPARATUS FOR PAIN CONTROL AND HEALING

(71) Applicant: MMJ LABS, LLC, Atlanta, GA (US)

(72) Inventors: Amy Baxter, Atlanta, GA (US); Robert E. Ratajczak, III, Atlanta, GA (US); Brian VanHiel, Atlanta, GA (US); Maureen E. Carroll, Atlanta, GA (US)

(73) Assignee: MMJ Labs, LLC, Atlanta, GA (US)

( * ) Notice: Subject to any disclaimer, the term of this patent is extended or adjusted under 35 U.S.C. 154(b) by 0 days.

(21) Appl. No.: 17/104,497

(22) Filed: Nov. 25, 2020

(65) Prior Publication Data

US 2021/0077343 A1 Mar. 18, 2021

(51) Int. Cl.
*A61H 23/02* (2006.01)
*A61H 7/00* (2006.01)

(52) U.S. Cl.
CPC ..... *A61H 23/02* (2013.01); *A61H 7/002* (2013.01); *A61H 2201/01* (2013.01); *A61H 2201/0207* (2013.01); *A61H 2201/0214* (2013.01); *A61H 2201/0285* (2013.01); *A61H 2201/10* (2013.01); *A61H 2201/165* (2013.01); *A61H 2201/5097* (2013.01)

(58) Field of Classification Search
CPC ..... A61H 23/00; A61H 23/02; A61H 2015/0064; A61H 2015/0071; A61H 39/00; A61H 39/02; A61H 39/04; A61H 7/002; A61H 7/005
USPC ..... 601/48, 46, 107, 111, 67, 69, 70, 72
See application file for complete search history.

(56) References Cited

U.S. PATENT DOCUMENTS

| | | | | |
|---|---|---|---|---|
| D171,941 | S * | 4/1954 | Iannelli | D24/214 |
| 2,748,763 | A * | 6/1956 | Kosloff | A61H 15/0092 601/131 |
| 5,902,256 | A | 5/1999 | Benaron | |
| 8,147,533 | B2 | 4/2012 | Baxter et al. | |
| 8,740,960 | B2 | 6/2014 | Baxter et al. | |
| 9,333,144 | B2 | 5/2016 | Baxter et al. | |
| 9,358,152 | B2 | 6/2016 | Baxter et al. | |
| 10,058,476 | B2 | 8/2018 | Baxter et al. | |
| 10,118,003 | B2 | 11/2018 | Baxter et al. | |
| 2002/0068886 | A1 * | 6/2002 | Lin | A61H 9/0078 601/15 |

(Continued)

OTHER PUBLICATIONS

Lu et al, "Does vibration benefit delayed-onset muscle soreness?: a meta-analysis and systematic review", Journal of International Medical Research, 2019, vol. 47(1). pp. 3-18.

(Continued)

*Primary Examiner* — Bradley H Philips
*Assistant Examiner* — Savannah L Gabriel
(74) *Attorney, Agent, or Firm* — Dickinson Wright, PLLC; Michael E. Noe, Jr.

(57) ABSTRACT

A device for treating a user includes a housing having apertures. The housing has application areas including a convex top surface, a concave bottom surface, a convex rear surface, convex side surfaces and rounded protrusions extending away from the housing. A vibrational source is located in the housing to produce vibration at the application areas. A switch is in operative communication with the vibrational source to control operation of the vibrational source.

18 Claims, 11 Drawing Sheets

(56) References Cited

U.S. PATENT DOCUMENTS

| | | | | |
|---|---|---|---|---|
| 2004/0073146 | A1* | 4/2004 | Weintraub | A61H 11/02 601/134 |
| 2005/0209537 | A1 | 9/2005 | Gleason et al. | |
| 2008/0188778 | A1* | 8/2008 | Chen | A61H 23/0245 601/15 |
| 2013/0197409 | A1 | 8/2013 | Baxter et al. | |
| 2014/0207029 | A1 | 7/2014 | Baxter et al. | |
| 2016/0095789 | A1 | 4/2016 | Baxter et al. | |
| 2017/0119620 | A1* | 5/2017 | Trapp | A61H 23/0263 |
| 2017/0367923 | A1* | 12/2017 | Bergbacka | A61H 23/02 |
| 2018/0369064 | A1* | 12/2018 | Baxter | A61H 23/00 |
| 2019/0070067 | A1* | 3/2019 | Marcu | A63B 37/08 |
| 2019/0262207 | A1* | 8/2019 | Lee | A61H 23/0263 |

OTHER PUBLICATIONS

Souron et al., "Acute and chronic neuromuscular adaptations to local vibration training", European Journal of Applied Physiology, Aug. 1, 2017, Springer, 26 pages.

* cited by examiner

SYSTEM, METHOD AND APPARATUS FOR PAIN CONTROL AND HEALING

TECHNICAL FIELD

This disclosure generally relates to pain control, myofascial treatment and healing using devices that mechanically stimulate specific receptors to override pain and directly effect tissues in a user, incorporating compression, with or without thermal effects, to physiologically improve pain and recovery.

BACKGROUND

History. Perhaps the first patients intentionally treated with vibration were those of neurologist Jean-Martin Charcot. After associating clinical improvement of his patients with Parkinson's Disease and prolonged train rides, he described in 1892 the creation of a similarly shaking chair—and similar clinical improvement.(1) Although his student Georges Gilles de la Tourette created (and published) data on a vibrating helm for migraine, little else was done with therapeutic vibration for half a century. In 1949, Whedon created an oscillating bed with physiologic and metabolic improvement of patients with whole body casts.(2)

Physiology of Pain Transmission. Muscle, skin and injury pain travel from the body to the substantia gelatinosa in the posterior half of the spine on Aδ ("A-Delta") fibers. Only 5% of neurons in the substantia gelatinosa transmit signals to the brain—95% are responsible for sensation modification and inhibition, so that stronger signals in arriving to the dorsal horn inhibit weaker ones.(3) Summary information is passed via interneurons to spinal fibers to the brain, with an interplay such that stronger signals in arriving to the dorsal horn inhibit weaker ones.

Physiology of Gate Control. In addition to Aδ pain fibers, Aβ ("A-Beta") nerves transmitting motion sensations and C-fibers transmitting cold information join in the substantia gelatinosa of the spinal cord. Sensory input is inhibited, enhanced, or modified, then summary sensations are transmitted to the brain. When Aβ large fiber afferents or C-fibers inhibit Aδ pain fibers, this is known as "Gate Control" pain inhibition, first posited in 1965 when Melzack and Wall(4) observed that mechanical Aβ stimulation could reduce pain.

The large A-Beta afferents transmit information from four receptors: Meissner (light touch), Pacinian (pressure, vibration), Ruffini (stretching and vibration passing in waves), and Merkel discs (deep touch). Each receptor has a maximally receptive frequency, and distribution in the body. Messiner are on the surface, Pacinian corpuscles are deeper and concentrated most prominently in cartilage and joints to transmit limb and torso position sense. Recent research has determined the frequencies at which each receptor responds: fast adapting light touch Meissner corpuscles detect frequencies between 2 and 40 Hz, while fast-reacting and long-acting deep Pacinian corpuscles begin sensing vibration at 65-250 Hz, with maximal sensitivity between 180-250 Hz.(5-8)

Mechanical excitation of mechanoreceptors. By transmission to limbs through weight bearing, motion and mechanical force pass through bones, tendons, muscles, and the cells that make them up. Integrins on cells recognize and respond to mechanical stressors; mechanical force itself can deform cells to open sodium channels, allowing ions to enter and leading to action potentials. The excitation of mechanical receptors can be accomplished with auditory or ultrasonic waves, pulsed electromagnetic fields, electrical stimulation, shockwaves, mechanical devices with motor-driven shaking platforms, or eccentric flywheels. Oscillatory mechanical stimulation, or vibration, is transmitted in waves that not only stimulate Meissiner and Pacinian corpuscles, but Ruffini as well. Because the transmission of mechanical force decays at different rates through skin, fat, muscle, and bone, an initial frequency decays slightly to slower frequencies as the waves of mechanical energy spread.(9) This gives the opportunity for focal vibration to stimulate four Aβ receptors for more robust pain inhibition.

Effect of mechanical stimulation on growth. Below a mechanical strain threshold, muscles atrophy and bone is resorbed. On a cellular level, stressors that exceed the minimum stimulation threshold prompt growth. Single whole body vibration sessions may increase overall oxygen uptake in tissues, thereby increasing microcirculation and blood flow. Over time, whole body vibration (WBV) works to decrease osteoclast activity, change gene expression of growth factors, and increase growth hormone expression.(10) As a more macro example, orthopedists do not typically immobilize humerus fractures because the microtensions from active shoulder muscles remodel bone faster than casting. Vibration acts as a mechanical stimulation that exceeds the threshold strain level, increasing cellular anabolic (growth) activity. In everyday life, cells and tissues undergo growth and remodeling with mechanical vibratory forces.(11) Walking, for example, generates vibratory waves with a frequency between 10 to 20 Hz.(12) For bone repair, work in rodents has demonstrated that femur fractures respond with growth to mechanical vibration, but not electrostimulation.(13)

Effect of mechanical oscillatory stimulation on repair. Focal vibration can work to induce mechanical changes of benefit to overuse injuries. Chronic overuse injuries, such as delayed onset muscle soreness after training, exhibit microscopic muscle tears. Multiple theories of pain production, including lactic acid, muscle spasm, inflammation, connective tissue damage, and enzyme efflux may contribute to both chronic and overused tissues. Imtiyaz, et al, have demonstrated that mechanical stimulation prior to exercise can be equivalent to some massage at reducing delayed onset muscle soreness,(14) likely through multiple mechanisms. Through mechanically reducing spasm and separating maximally coupled actin/myosin bonds vibration facilitates initially increased muscle contraction strength. This separation may also facilitate subsequent movement without re-injury and subsequent increased lactic acid production. Vibration increases range of motion and blood flow, both of which may reduce micro-injury and facilitate removal of pain-inducing cytokines and reduction of pain.(15) Given the mechanical benefits of muscle fiber separation, potentiation and blood flow coupled with pain relieving qualities of vibration, focal mechanical stimulation has broad current use in sports medicine. For physiologic repair, high frequency vibration at 150 Hz reversed hypotrophy of the quadriceps while electrostimulation did not.(16) Focal vibration improved range of motion,(17) reduced post-operative knee laxity,(18) and post-surgical pain in a variety of locations.(19-21) Additional research on FV suggests that stimulating the Ia and II afferents may add inhibition to the gate control pain relief, (22) with neuromuscular adaptation over time providing longer range pain reduction after vibration is applied in a local muscle group in OA patients.

Penetration of mechanical stimulation. Newton's third law states that for every action, there is an equal and opposite reaction. With mechanical force delivered by an eccentric flywheel, stochastic membrane, or piston, for example, unless an external pressure is applied the body will recoil and the therapeutic benefits of the mechanical stimulus will not penetrate into the tissues. To optimally apply mechanical force, the torque of the moment of the flywheel can be perpendicular to the surface to be penetrated, and there can be a compression or fixed external restraint to prohibit the force from recoiling away from the surface. The penetration horizontally decays laterally, stretching in a wave that activates Ruffini corpuscles and Meissner as the speed of the lateral wave decays, (23) enhancing pain relief in a way electrical impulses do not.

Descending (or diffuse) noxious inhibitory control. Ice or deep pressure are transmitted by C-fibers, unmyelinated fibers running alongside A-beta nerves. When stimulated over time, they are processed in the anterior cingulate gyms and send descending inhibition of pain. This mild stimulus of pain inhibiting a stronger stimulus is also called "conditioned pain modulation" or CPM response.(24, 25) In order to combine the effects of mechanical stimulation and ice, the source of cold cannot absorb vibration (as with a gel).

Mechanical stimulation analgesia works through central and peripheral nerve mechanisms, not cognitive. Vibration does not reduce pain through distraction-"Vibro-tactile stimulation effectively recruited analgesic mechanisms not only in NC[normal controls] but also in patients with chronic musculoskeletal pain, including FM[fibromyalgia]. Distraction did not seem to contribute to this analgesic effect." (26) " . . . the results suggest that touch gating is a robust, stimulus-locked form of sensory interaction, rather than a transitory result of distraction or other cognitive processes."(27) " . . . little evidence to support the view (widely held by subjects) that distraction is the mechanism of vibratory analgesia."(28)

High Frequency low amplitude mechanical stimulation for vasodilation. Increasing vein diameter (vasodilation) is extremely important for healing, recovery and rehabilitation. Devices in the prior art that have sought to induce vasodilation have used dramatically different means, including electrical stimulation and subsequent muscle contraction (US 2011/0071595), vacuum suction (U.S. Pat. No. 5,454,778), and compression (U.S. Pat. No. 6,129,688). Vibration is capable of improving blood flow, enlarging the diameter of veins through sympathetic nerve stimulation, which induces the mechanism of endogenous nitric oxide release.(29) Additional support for this comes from the reduction of fainting and vasovagal symptoms when a needle is distal to a high frequency by sympathetic release, overcoming the potential for parasympathetic vasovagal response.(30) In addition the benefit of vasodilation can directly reduce pain from claudication (pain from inadequate blood flow).

High Frequency low amplitude mechanical stimulation for lymphatic drainage. Reducing edema through stroking tissues in part results from removing the passive accumulation of lymph in the extra-circulatory system lymphatics. While pressure alone with stroking are currently used, the addition of mechanical stimulation in a shaped hand-held device could facilitate drainage. Placement alone of vibration has demonstrated improved drainage,(31) but no devices suitable for manipulation of lymphatics incorporating vibration exist. Vibration as part of therapy improves conditions where lymphatic accumulation causes pain and delayed healing, as in mastectomy.(32) Thus, combining a device capable of both myofascial manipulation of tissues with mechanical stimulation is contemplated.

High Frequency low amplitude mechanical stimulation for myofascial trigger points. Nerves and spasmed muscles can be identified under ultrasound and physical examination and manipulated to reduce pain, either through direct pressure, shockwave therapy,(33) or dry needling. Focusing mechanical stimulation into a point for compression would facilitate treatment of myofascial trigger points.

High Frequency low amplitude mechanical stimulation for menstrual, post-operative, or uterine pain. The smooth muscle of uterine contractions is similar to skeletal muscle, but without voluntary control. Both through the a-Beta gate control mechanisms, reducing spasm, and the addition of thermal mechanisms a compressed device for any source of uterine pain, from IUD insertion, endometriosis, fibroids, or other pelvic pain is envisioned.

High Frequency low amplitude mechanical stimulation for neurorehabilitation and performance. After brain injury, rehabilitation includes repetitive movements to trigger development and anabolic myelination/regrowth of extremity to brain pathways. Research has demonstrated that 80-120 Hz stimuli speed the recovery of function,(34) as well as 150-200 Hz reducing pain.(35) Furthermore, a device shaped to conform easily to an extremity could facilitate lowering the threshold to determine balance and gait, improving position sense.(36) This has been done with plantar vibration, but the physiologic mechanism should improve posture when applied to the vastus medialis to activate for terminal muscle activation.

Therefore, there is a need for an intentional agent (device and/or method) to increase vasodilation overcoming vasoconstrictive effects of cooling, improve blood flow for healing, reduce pain through signaling, which would include both vibration stimulation and a shape suitable to conform to the body. As ease of use is critical in promoting self-efficacy for home applications, and to speed adopting in medical environments, embodiments that include rechargeable options, moveable locations, optional numbers of vibration units, or the attachment option to include cold or heat also are contemplated.

Accordingly, there is a need for optimal frequency, orientation, and compression to maximally stimulate Pacinian corpuscles in a manner allowing for wave decay through tissues to further stimulate other mechanoreceptors. This device would allow for the local improvement of blood flow through vasodilation from vibration. There also is a need for a device and method using vibration or a combination of vibration and thermal element that is applied to a subject subsequent to injury, surgery, cramping, myofascial trigger points, or tissue damage or overuse for pain control and enhancement of recovery in which the hot or cold element is solid and can transmit the frequency unimpeded.

Techniques known as instrument assisted soft tissue mobilization (IASTM) are commonly used during physical therapy and rehabilitation to break up fascial adhesions, promote blood flow, and improve overall mobility while decreasing pain. This is another form of treatment for myofascial trigger points. See, e.g., www.hawkgrips.com. Originally, IASTM was referred to as Gua Sha, a Chinese approach of aggressively scraping the skin to elicit inflammatory responses. Using the angulated edge of a conventional unpowered device (e.g., typically a plastic or metal rod), this method scrapes across the top of the skin in the various fascial planes and muscle orientations appropriate for the particular body part. The edge of the device is generally at an angle of about 30 to 45 degrees, relative to the surface of the skin. Currently, all IASTM tools are unpowered. There are no IASTM tools that include vibration. Accordingly, improvements in IASTM and therapy tools continues to be of interest.

SUMMARY

This disclosure describes methods and devices for reducing pain and improving performance by activating nerves, mechanically moving tissues to reduce damage and improve recovery, stimulating neurologic response and increasing local blood flow. For example, a method comprises compressing a device to or proximal to a site of pain or restricted blood flow, for example, to a chronic injury or recent surgery, initiating vibration in a range (e.g., 180-250 Hz) with torque oriented to penetrate the skin, with or without hot or cold thermal effects capable of transmitting the amplitude and frequency of the mechanical force.

One method comprises reducing the pain sensation caused by surgery comprising contacting a device between the spinal cord and the site of the procedure, initiating continuous vibration by the device, optionally applying heat or cold simultaneously with the vibration to interfere with transmission of pain signals by nerves (e.g., aDelta nerves) and muscular spasm.

Another method comprises reducing pain from overuse injuries, comprising contacting a device to a site of restricted motion or pain, initiating vibration by the device, optionally applying a thermal effect simultaneously with the vibration, and reducing the restricted motion through mechanically separating actin and myosin in the muscle, or reducing pain for example by interfering with the transmission of nerve signals by aDelta nerves at the site of overuse.

Still another method comprises reducing pain from myofascial trigger points, comprising contacting a device to a site of spasm or pain, initiating vibration by the device, optionally applying a thermal effect simultaneously with the vibration, and reducing the restricted motion through mechanically pressing the trigger point area to achieve release and reduction of pain by aDelta nerves at the site of overuse.

Yet another method comprises reducing pain from lymphatic edema, comprising contacting a device to a site of edema, initiating vibration by the device, optionally applying a thermal effect simultaneously with the vibration, and reducing the edema through mechanically stroking the lymphatics to achieve release and reduction of pain by reducing accumulated lymph and promoting normal blood flow to the area to further speed healing.

A different method comprises improving neurorehabilitation, comprising contacting a device to an extremity or area with reduced strength, e.g. secondary to stroke or prolonged inactivity, initiating vibration by the device, optionally applying a thermal effect simultaneously with the vibration, and improving strength and/or control through increased mechanical stimulation of neural pathways.

Another method comprises improving balance, e.g. as a part of neurorehabilitation, comprising contacting a device to an extremity or area with reduced strength, initiating vibration by the device, optionally applying a thermal effect simultaneously with the vibration, and improving balance and/or control through increased activation of the muscle via lowering the threshold of firing neurons through the mechanical stimulation of local neural pathways.

Still another method comprises improving pain from smooth muscles (e.g. uterine contractions, masses, or post-surgical pain), comprising contacting a device to the lower abdomen, initiating vibration by the device, optionally applying a thermal effect simultaneously with the vibration, and improving blood flow or reducing cramping while blocking aDelta pain through the mechanical stimulation of a-Beta nerves and local neural pathways.

A method comprises reducing pain through empowering patients, optionally providing a choice of thermal effects simultaneously with the vibration, and modulating the pressure of the compression to impact penetration of the mechanical force.

A device comprises a casing or housing that can be shaped to conform to the contour of a surface. The device contains a vibratory element and an optional thermal element. In an aspect, a casing or at least one surface of a casing, is shaped to fit a curved surface of the body. For example, one surface of a casing may be concave, shaped like the inner surface of a circle, and when the device contacts a surface, such as an arm, the concave surface of the casing substantially contacts the arm surface, meaning that a majority of the concave surface is in contact with the area of the surface. This contact of substantially the entire concave surface of the device allows for enhanced transfer of vibration and/or thermal effect to the surface. Vibration effects can be provided by any of the known vibratory devices such as, for illustrative purposes, a vibratory motor provided within the casing, a membrane vibrating or pulsing, or a piston with gear directed at the skin. Once vibration in a range of, for example, 180-250 Hz is initiated by providing power to the vibratory source, such as a vibratory motor, the duration of the vibration may or may not be controlled externally.

An exemplary embodiment of the device comprises a casing housing the various components and a compression strap for holding the device with sufficient force to overcome Newton's Third Law to the subject. The casing may be manufactured of a stiff material to transmit vibration, and may be placed into a more flexible or pliant material in the form of a covering. The casing can be any shape, and can conform to specific body parts, particularly fingers, low back, feet, arms, and legs. For example, an application area may be concave or convex so conform to rounded areas of the body to which the device may be applied. Any other shape may be employed, so long as the shape is large enough and structured so as to be able to contain the various working components. Embodiments can include adhesive to attach a vibrating mechanism to the body or skin surface.

A method comprises providing a device externally to the skin surface of a subject. For example, the subject may be a human or animal subsequent to muscle overuse, injury or surgery. The vibratory device may be placed at the site of musculoskeletal pain, or may be placed proximal to such sites. In some methods, the vibratory device is placed at two sites simultaneously, as with both medial and lateral meniscal areas of a knee post injury or surgery. Methods allow for increased blood flow, reduction of pain and unpleasant sensations (e.g., burning, itching), increased healing, or for stimulating bone growth.

These features, and other features and advantages will be apparent to those of ordinary skill in the relevant art when the following detailed description of the embodiments is read in conjunction with the appended drawings in which like reference numerals represent like components throughout the several views. The figures and the detailed description which follow more particularly exemplify these and other embodiments.

BRIEF DESCRIPTION OF THE DRAWINGS

The accompanying drawings, which are incorporated in and constitute a part of this specification, illustrate several aspects and together with the description serve to explain the principles.

DETAILED DESCRIPTION

Figure 1:
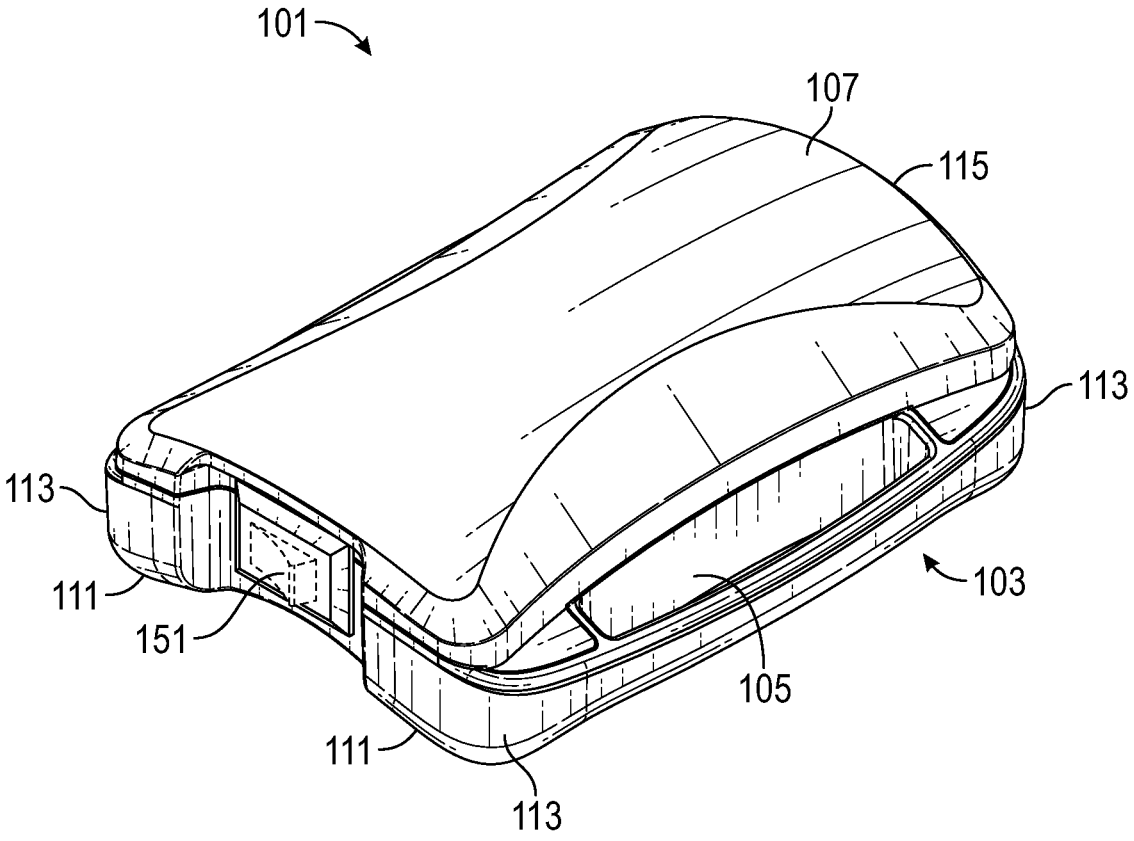
FIG. 1 is top isometric view of an embodiment of a device.
Figure 2:
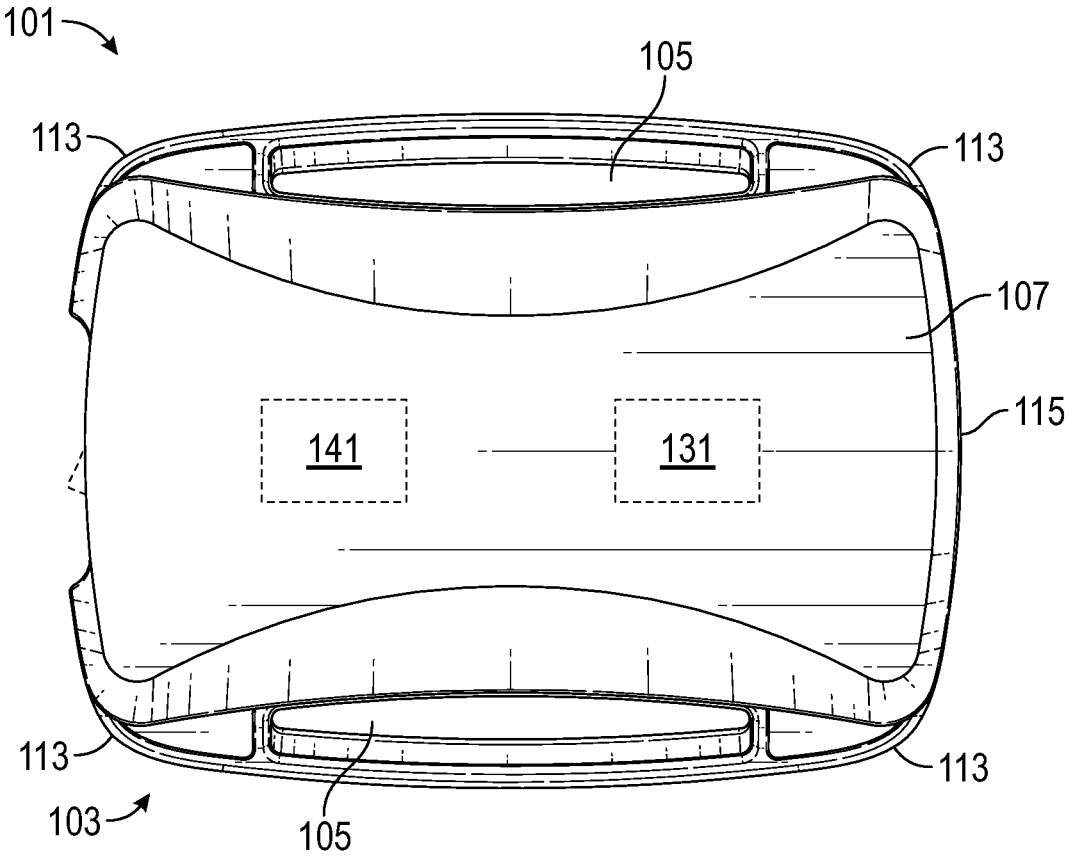
FIG. 2 is a top view of the device and is shown with optional components.
Figure 3:
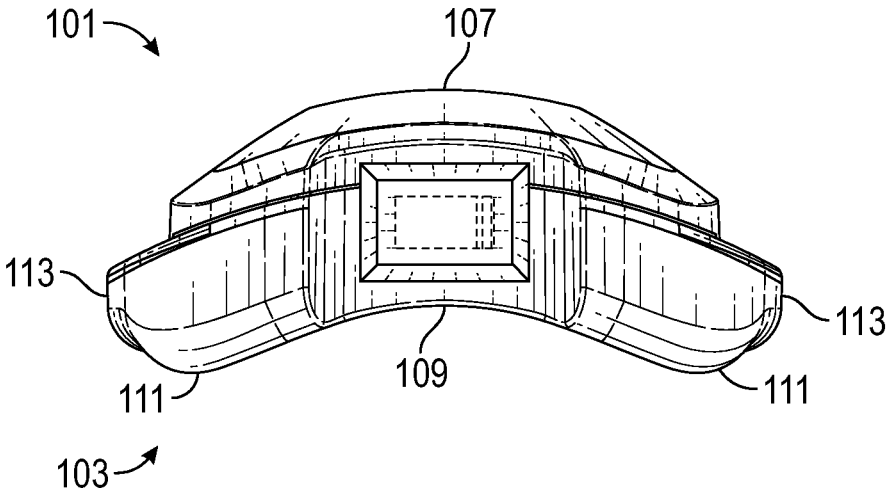
FIG. 3 is a front view of the device.
Figure 4:
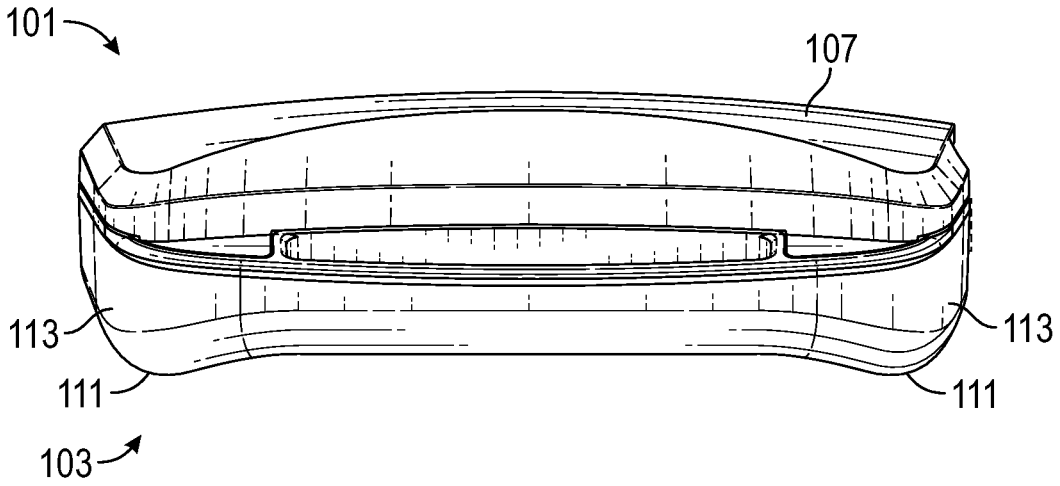
FIG. 4 is a side view of the device.
Figure 5:
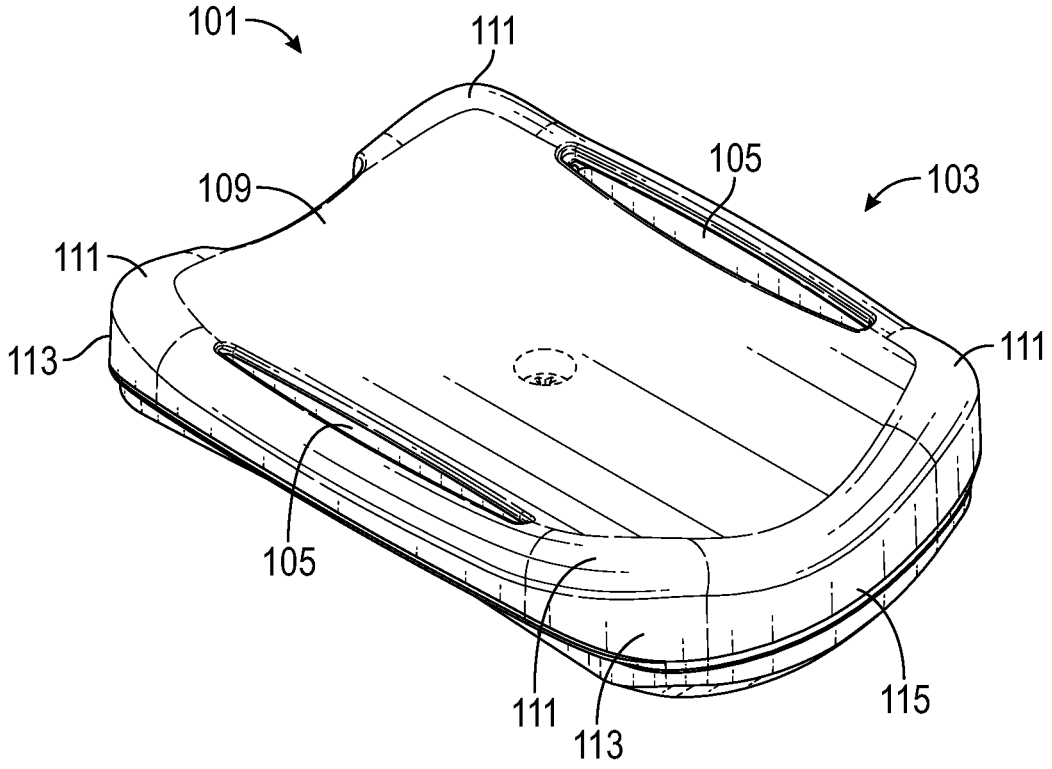
FIG. 5 is a bottom isometric view of the device.
Figure 6:
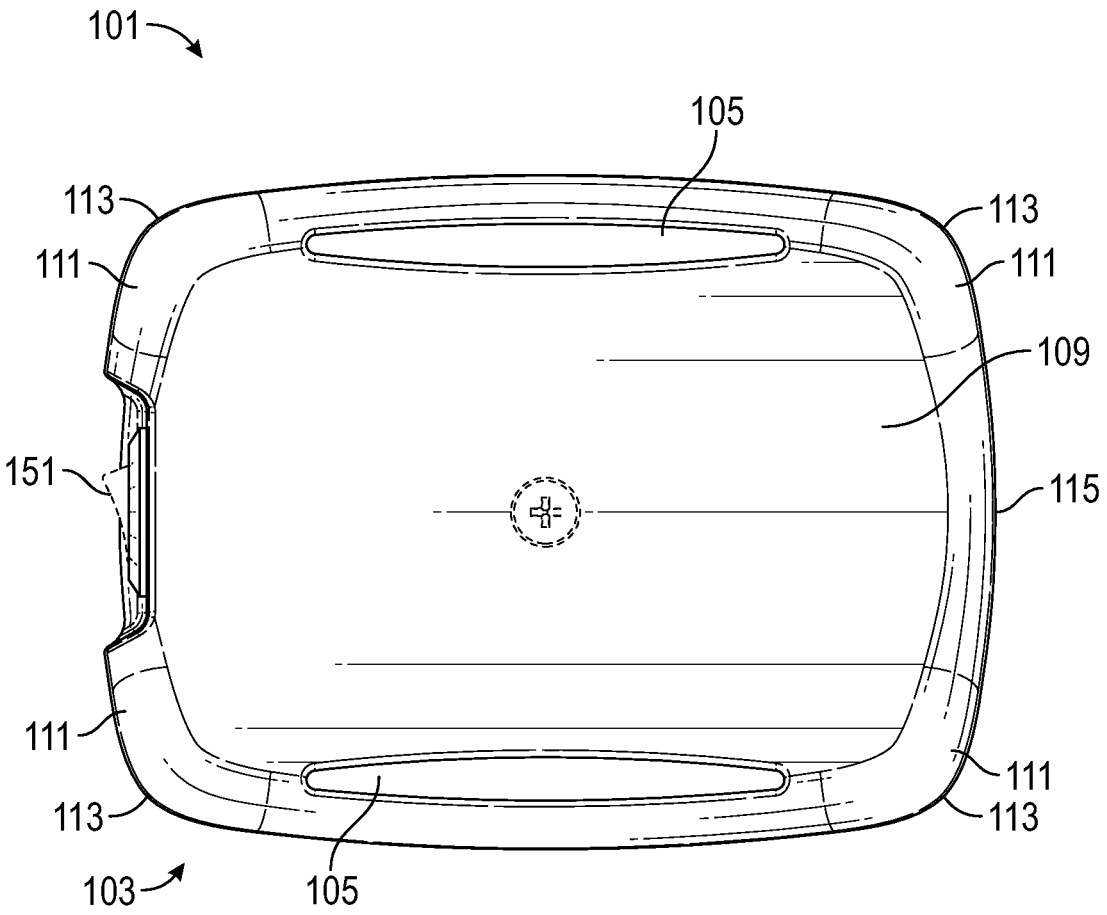
FIG. 6 is a bottom view of the device.

As shown in FIGS. 1-16, embodiments comprise systems, method and devices for reducing pain or sensation. For example, FIGS. 1-6 depict an embodiment of a device 101 for treating a user. The device 101 can include a housing 103 having apertures 105 and a plurality of application areas comprising a convex top surface 107, a convex bottom surface 109 and rounded protrusions 111 extending away from the housing 103.

Versions can further include a vibrational source 131 in the housing 104. The vibrational source 131 can be configured to produce vibration at the plurality of application areas. In some examples, at least some of the plurality of application areas allow simultaneous transfer of both thermal effects and vibration to a site of the user. In one embodiment, a combination thermal effects and vibration are configured to produce a thermal analgesia treatment and a vibrational analgesia that are effective to at least one of:

- reduce pain associated with a site of the user,
- improve a wound associated with a site of the user,
- improve performance and/or recovery of muscle associated with a site of the user,
- enhance neurologic performance or recovery,
- reduce edema through lymphatic drainage
- reduce pain through manipulation of myofascial trigger points, or
- enhance healing associated with a site of the user.

Figure 14:
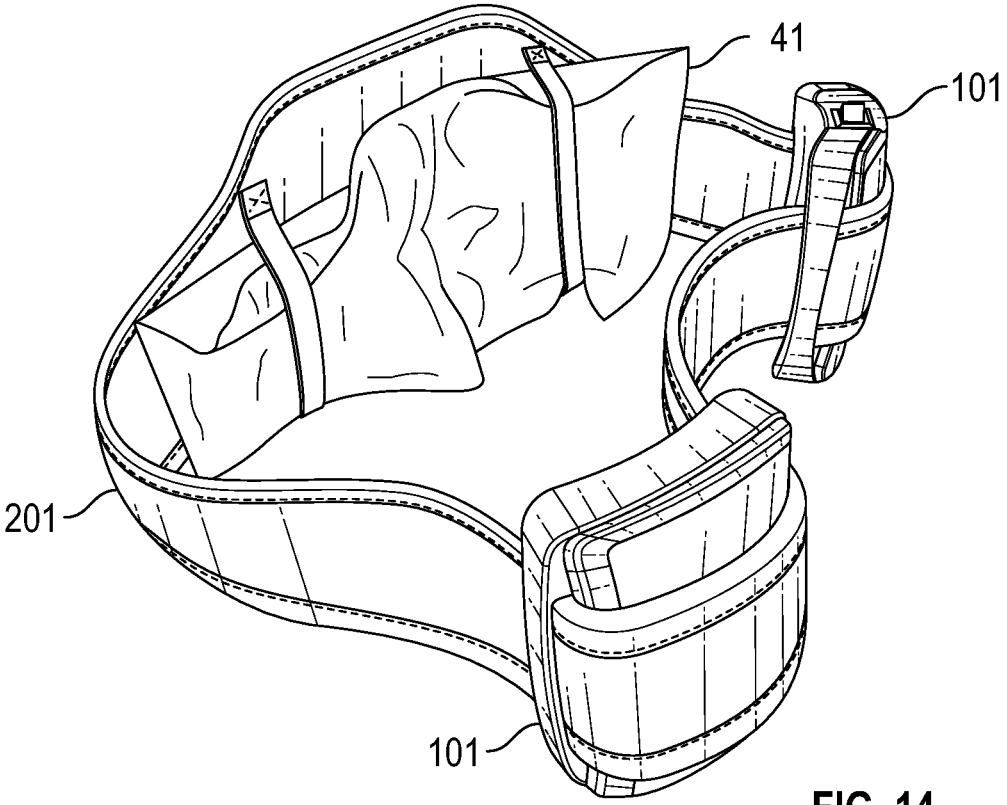
FIG. 14 is an isometric view of another embodiment of a brace with two devices.
Figure 15:
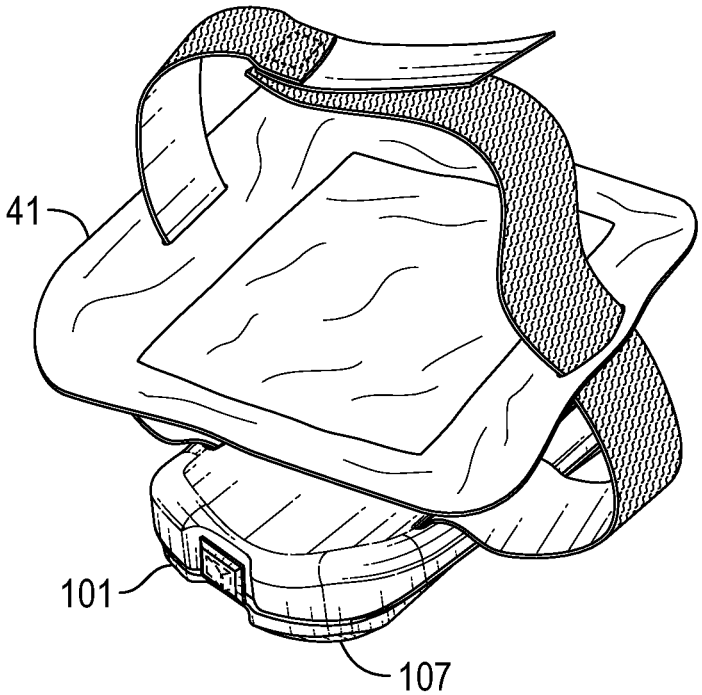
FIG. 15 is an isometric view of still another embodiment of a brace, device and thermal pack.
Figure 16:
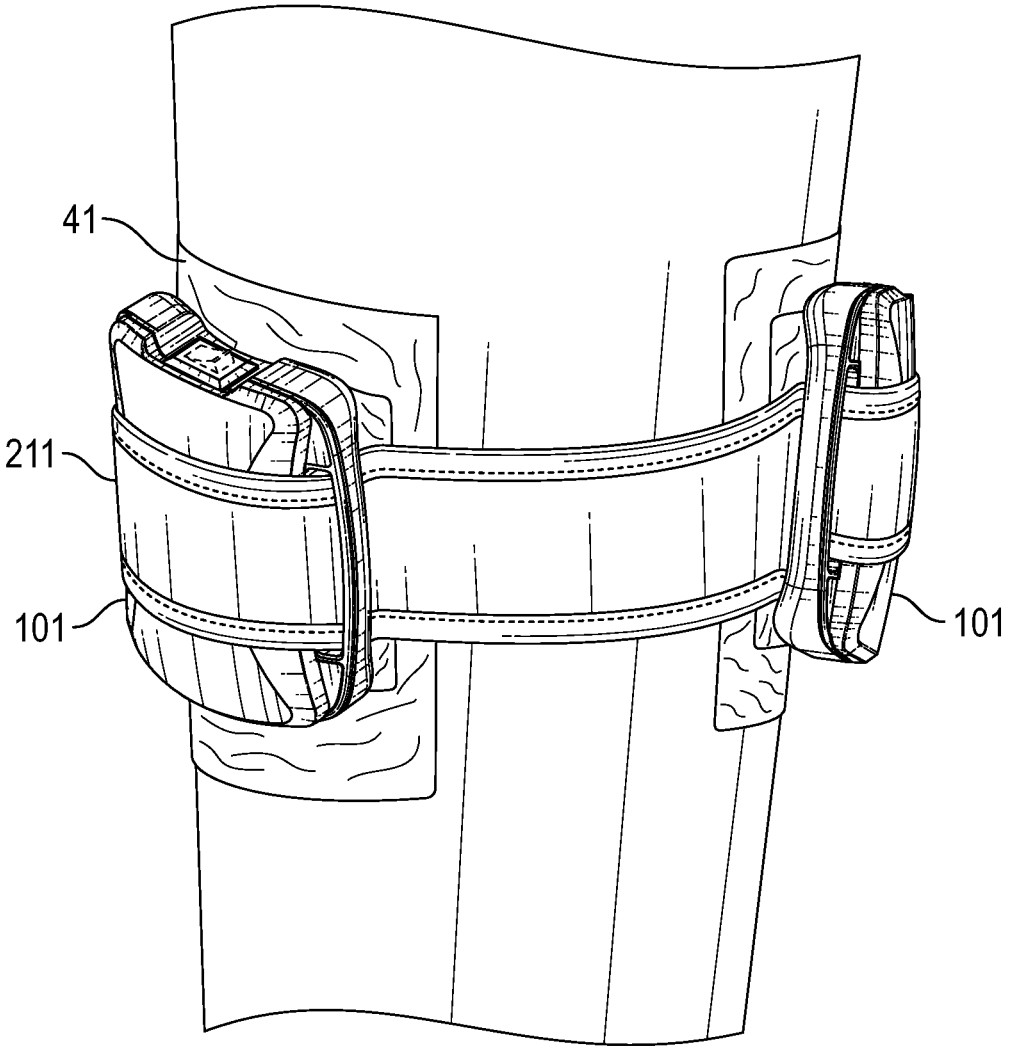
FIG. 16 is an isometric view of yet another embodiment of a brace, devices and one or more thermal packs, and stereotactically amplifies the vibratory effects by positioning the devices opposite each other on a patient.

Examples of device 101 also can include a thermal element 41 or 141 outside or inside, respectively, of the housing 104. The thermal element 41 or 141 can be configured to produce thermal effects that can be hot or cold at the plurality of application areas. Embodiments of the thermal element 41 can comprise an external hot pack and/or cold pack 41 (FIGS. 14-16). However, unlike conventional packs, the hot pack and/or cold pack can be solid and rigid (rather than flexible) for better transmission of vibration from the device 101 to the patient. In addition or alternatively, the thermal element 141 (FIGS. 2 and 10) can be at least one of a Peltier cooler, thermoelectric heat pump, thermoelectric cooler, Peltier heater or electric heating element, and the device is configured to initiate at least one thermal effect by activating the thermal element by using the switch 151.

Embodiments of device 101 can include a switch 151 in operative communication with the vibrational source 131 for controlling operation of the vibrational source 131, and with the thermal element 141 for controlling operation of the thermal element 141.

Figure 7:
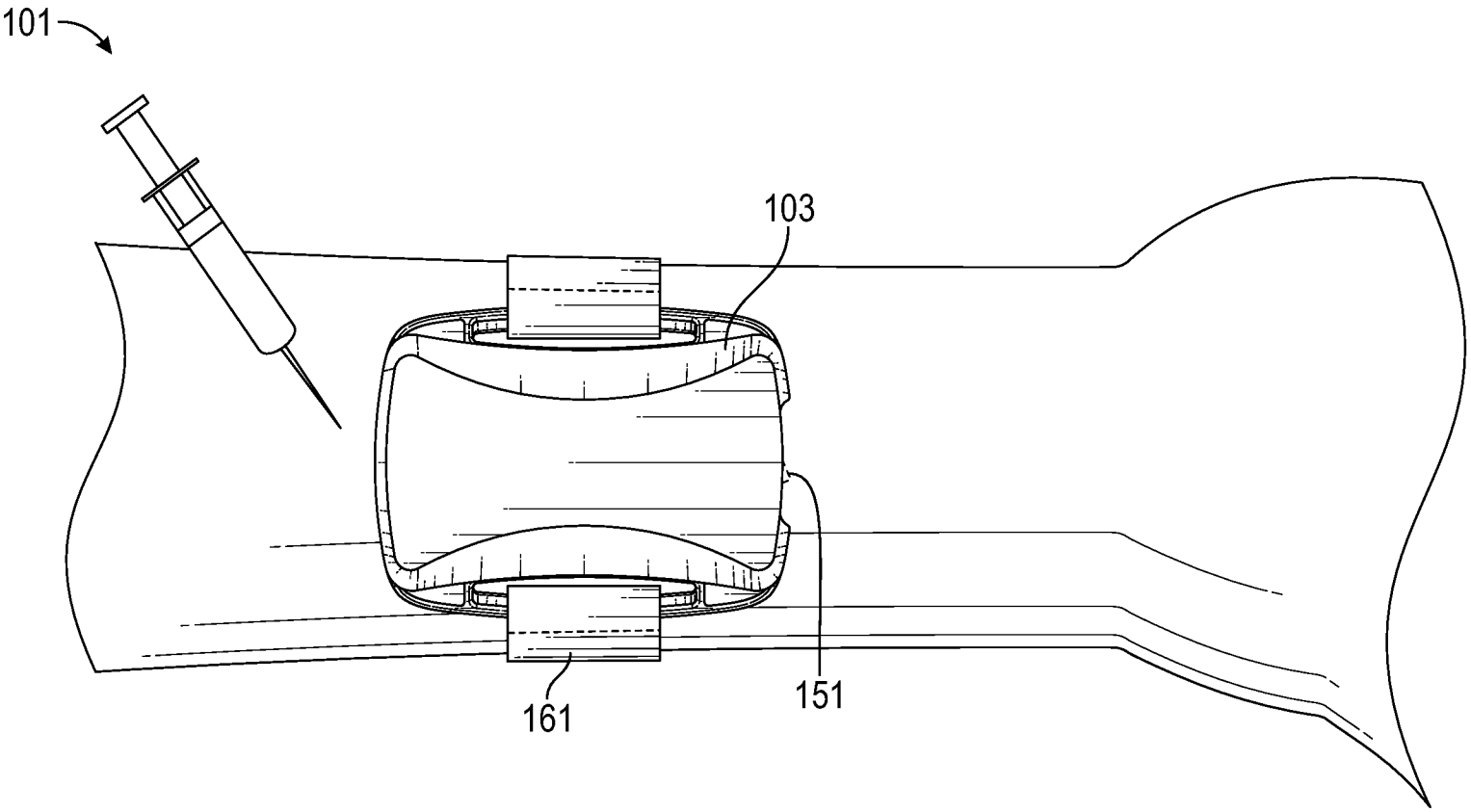
FIG. 7 depicts an embodiment of the device with a strap and in operation.
Figure 8:
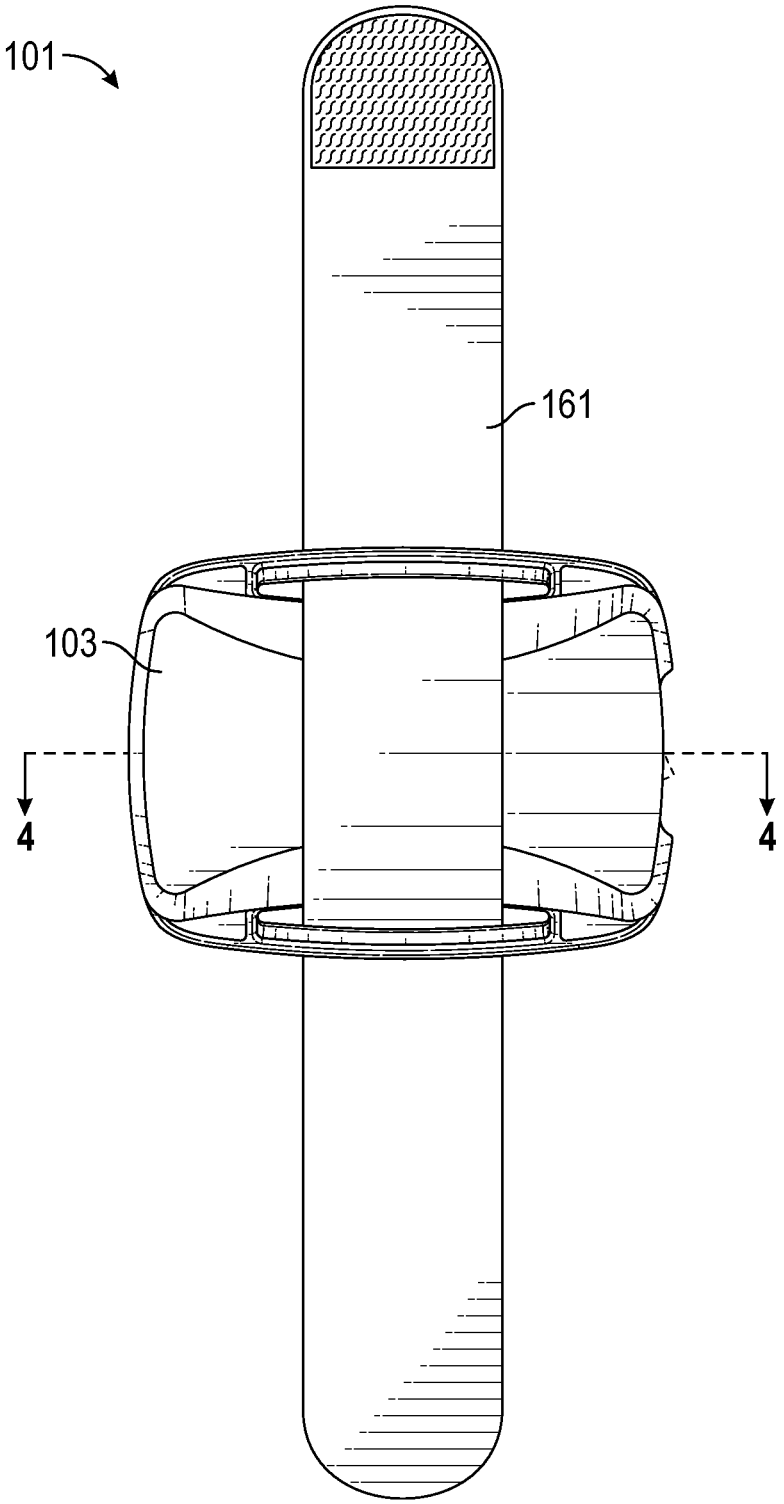
FIG. 8 is a top view of an embodiment of the device attached to a strap.
Figure 9:
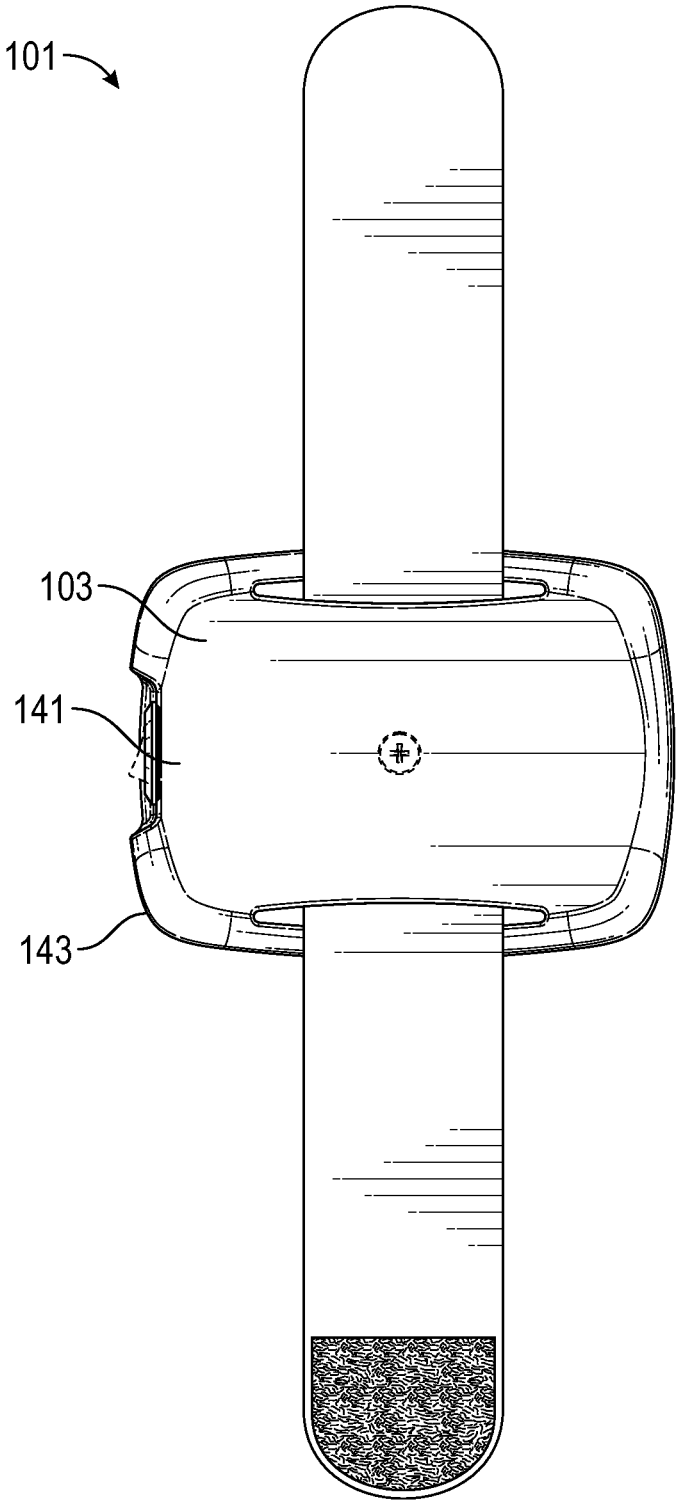
FIG. 9 is a bottom view of an embodiment of the device attached to a strap in a different way.

As shown in FIGS. 7-9, the device 101 can further include a strap 161. The strap 161 can be woven through apertures 105 in the housing 103 for restraint of the device 101 and attachment of the device 101 to the user.

Figure 12:
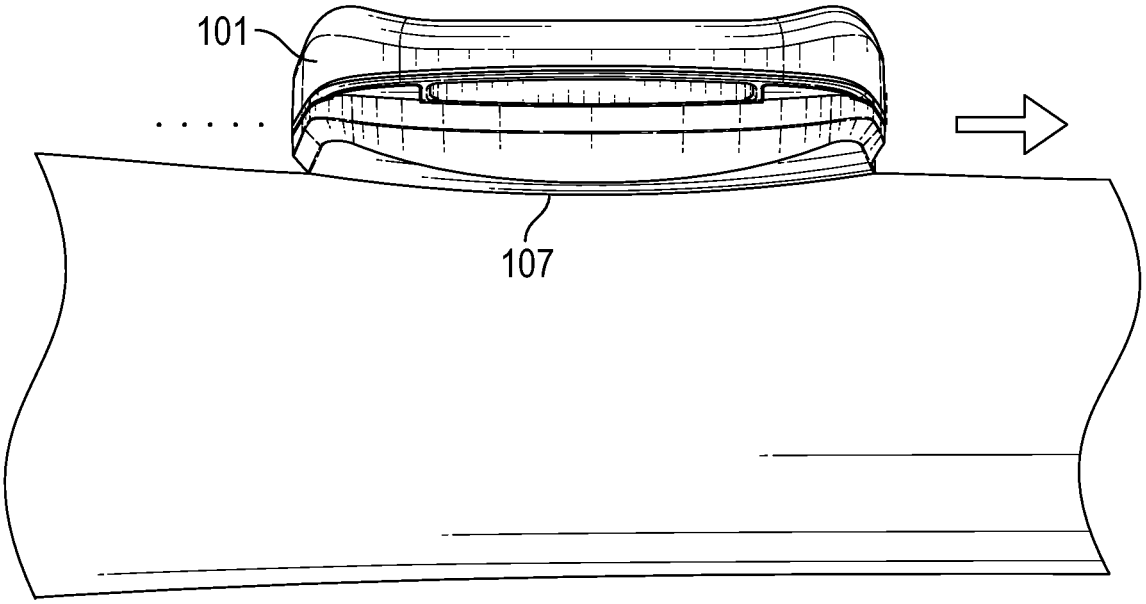
FIG. 12 is a side view of an embodiment of the device in operation with its convex side in sliding motion contact for focused vibration on a body of a patient.
Figure 13:
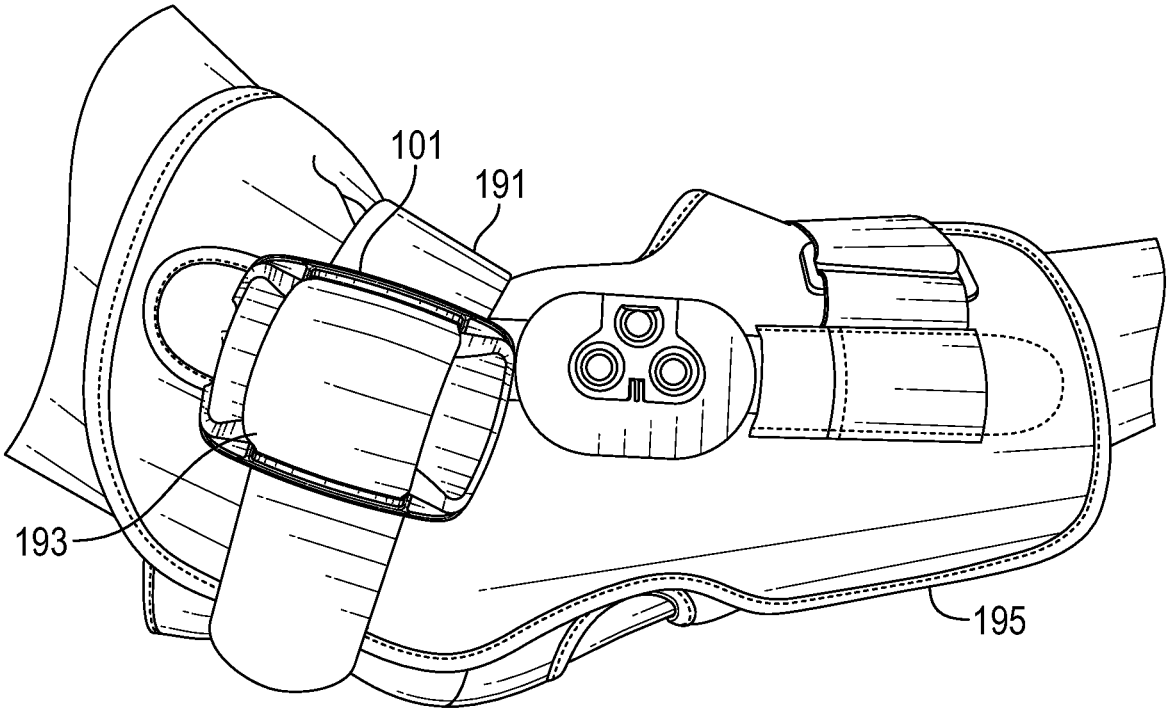
FIG. 13 is an isometric view of an embodiment of a brace with two devices.

FIG. 12 depicts the device 101 further including a brace 171. The brace 171 can have a pocket 173 to support the device 101. The brace 171 can be configured to be mounted to the user.

Embodiments can comprise a different brace 195 (FIG. 13) having a strap 191 for connection 193 to a device 101. The device 101 can include one or more of the devices 101 that are identical to each other. The brace 185 and strap 191 can be configured to support the device(s) 101. The brace 195 is configured to be mounted to the user.

FIG. 14 includes an alternate form of a brace 201 for coupling with two or more devices 101. Brace 201 can be attached to the user for the treatments described herein, including an optional thermal element 41. FIG. 15 depicts another optional brace for device 101 and thermal element 41 with the convex top surface 107 facing outward. FIG. 16 depicts two devices 101 aligned along a strap 211 to stereotactically amplify the vibratory effects by positioning the devices 101 opposite or juxtaposed to each other on a user, with or without thermal elements 41

Examples of the device 101 can include the housing 103 formed from a single thermally conductive and rigid material. The plurality of application areas of the housing 103, described herein, can further comprise four sides with rounded corners 113. In some versions, the rounded protrusions 111 extend from a bottom of the housing 103 and wrap around bottoms of the corners 113 of the housing 103.

In some embodiments of the device 101, the switch 151 comprises a wireless device having application software configured to transmit instructions regarding operation of the device. The application software can operates to perform at least one of:

- present information regarding operation of the device 101 to the user via a graphic user interface on the wireless device;
- receive instructions regarding operation of the device 101 from the user; or
- transmit instructions to the device 101.

Operation of the device 101 can include selection of a vibration parameter comprising at least one of a continuous vibration cycle, an intermittent vibration cycle, a frequency of vibration or an amplitude of vibration. Embodiments of the device 101 can include a vibration frequency, e.g. in a range of about 30 Hz to about 90 Hz for delayed onset muscle soreness, about 50 Hz to about 120 Hz for neurorehabilitation, about 100 Hz to about 300 Hz for muscle recovery and muscle mass, and/or about 180 Hz to about 250 Hz for pain. Multiple effects can be obtained with multiple motors, or effects outside the currently described frequency ranges. The device 101 also can include a vibration amplitude is in a range of about 0.1 Newton (N) to about 3.0 N.

In some embodiments of the device 101, each of the plurality of application areas can be configured to perform a different technique of instrument assisted soft tissue mobilization (IASTM) on fascia of the user. For example, these can include:

- rounded, convex corners 113 of the device 101 can be used interchangeably for a first type of IASTM comprising concentrated mechanical stimulation at myofascial trigger points procedures;
- the rounded protrusions 111 can be for a second type of IASTM comprising lymphatic drainage procedures;
- the convex top surface 107 can be for a third type of IASTM comprising concentrated mechanical stimulation of the body of a spasmed or cramped muscle procedures;
- the concave bottom surface 109 can be for a fourth type of IASTM comprising activating muscle during motion procedures, reducing pain under a brace, improving range of motion and improving range of motion under a brace; and
- a concave rear end 115 of the device 101 is located opposite the switch 151 and also can provide a second type of IASTM for lymphatic drainage procedures.

Methods of relieving pain or improving procedural success by improving blood flow of a user also are disclosed. For example, one embodiment of the method can include:

(a) providing a device comprising a housing having a plurality of application areas for contacting skin of the user skin directly or non-directly through a non-insulating membrane (e.g., cloth or adhesive dressing);

(b) applying vibration to the user with the device;

(c) providing thermal treatment to the user with the device while the device is vibrating;

(d) maintaining steps (b) and (c) for a time period and producing a vasodilation effect on the user to relieve pain of the user or enhance blood flow in the user.

In another example, steps (b) through (d) can occur with the device mounted to a restraint that permits passage of vibration and thermal treatment to the user. In some versions, step (c) includes cooling skin of the user to a temperature of at least about 45° F. Still other examples can include step (c) warming skin of the user to a temperature in a range of about 100° F. to about 120° F. Some embodiments of step (b) can include vibrating in a range of about 30 Hz to about 60 Hz for delayed onset muscle soreness of the user, about 100 Hz to about 300 Hz for muscle recovery and muscle mass of the user, and/or about 180 Hz to about 250 Hz for pain of the user.

Versions of the method can further comprise placing the device on the user at a position where pain from decreased blood flow will occur and a head of the user, and moving the device along a nerve path of the user. Other versions of the method can further comprise placing and moving the device on the user at a position proximal to a nerve plexi on the user.

Examples of videos and demonstrations of IASTM technique include the following, each of which is incorporated herein by reference in its entirety.

Mark Butler, PT—variety of treatments
www.youtube.com/watch?v=uQv8IqU21Mw&feature=emb_logo Benny Vaughn, PT—Plantar fasciitis
www.youtube.com/watch?v=H_Nlav6JP5s Brent Brookbush—Variety of Treatments (non hawkgrips)
www.youtube.com/watch?v=5FTilVzC-MA The following article includes information about light therapy, IASTM and light hand massage, and also is incorporated herein by reference in its entirety.

www.sciencedirect.com/science/article/abs/pii/S1360859220300309

In FIG. 7, an embodiment of the device 101 is shown as applied to the arm of a subject. In one example, the device 101 is being applied to the arm of a subject to with an overuse tendinitis. The positioning of the device 101 on the subject is directly on the medial tendon location of "tennis elbow". The device 101 can have a housing or casing 103 that houses the various components and an optional strap 161 for holding the device 101 to the subject are shown. The casing 103 may be manufactured of a flexible or pliant material or a rigid material, such as for illustrative purposes a natural or synthetic woven or non-woven fabric, a rubber or other flexible polymer material, or a silicone-based material, to provide an enclosed structure. Other flexible or pliant or other materials may be employed. The materials can be non-toxic, hypo-allergenic and non-staining to the subject. A material that will transfer vibrations is contemplated by this disclosure.

The casing can be any shape, such as a three-dimensional polygon (for use with an adult use) or an animal or other distractive shape (for use with a child) and having a hollow interior or interior sections for containing the operating elements. Any other shape (as used herein, the term shape is used in the broad sense of three-dimensional works) may be employed, so long as the shape is large enough and structured so as to be able to contain the various working components as more fully disclosed below.

A minimal embodiment of the external features is shown in FIG. 8, comprising the casing 103 and an on/off switch 151, with both vibration and thermal capabilities. The strap 151 can be provided to hold a hot or cold pack and can be used to hold the device 101 on the subject. The strap 151 can be attached to the casing 103 in any conventional manner or can be an extension of casing 103 itself. The ends of strap 151 can include a connecting device, such as a hook and loop fastener, a clasp, a clip, snaps, magnets, adhesive or the like for attaching the device about the subject's body part with the ability to compress the device. Alternatively, if the ends of strap 151 are flexible, the ends can be tied together around the subject's body part. The latitudinal edge of the casing also is defined along section line 4-4.

A compressive strap holds the device on to the subject. The strap can be attached to the casing in any conventional manner or can be an extension of casing itself. For example, the strap and casing can be attached together much like a conventional watch and watchband with hinges or pins. Or in another embodiment, the strap can be an extension of the fabric or other material of casing. The ends of the strap can include a connecting device, such as a hook and loop fastener, a clasp, a clip, snaps, magnets, adhesive or the like for attaching the device about the subject's body part. Alternatively, if the ends of the strap are flexible, the ends can be tied together around the subject's body part.

Referring now to FIG. 9, a bottom view of an embodiment is shown with both vibration and thermal capabilities. The casing 103 has a peripheral bottom rim that defines an application area. The application area can comprise a thermal area and a vibration area. Although the thermal area and vibration area are shown as discrete areas, this is for illustrative purposes only, as there need not be any physical delineation between the thermal area, the vibration area, and the application area. The thermal element 141 can cooperate with the thermal area to apply cold or heat to the subject. The vibrational source 131 can cooperate with the vibration area to apply vibration to the subject. The thermal area and vibrational area can occupy the same area.

The casing 103 can have a peripheral bottom rim that defines an application area. Application area comprises thermal area and vibration area. Although thermal area and vibration area are shown as discrete areas, this is for illustrative purposes only, as there need not be any physical delineation between thermal area and vibration area and application area. As disclosed in more detail below, thermal cooperates with thermal area to apply cold or heat to the subject, and vibrational source cooperates with vibration area to apply vibration to the subject. Thermal area and vibrational area can coextend.

The thermal pocket is a slot, fold or other type of compartment in the casing into which the thermal element can be placed. The thermal element pocket is accessed on the side of the casing via a mouth. Alternatively, the mouth can be located at other locations on the casing depending on the size and shape of casing and the location of the vibrational source within the casing. Alternatively, the thermal element can be contained within the main housing volume of the casing. Thus, the placement of the thermal element is variable so long as the cooling or heating effects of the thermal element can be felt on the subject so as to produce thermal vasodilation. Thermal area in its simplest form is an area on the application area on the device that allows the thermal effects from the thermal element to contact the subject.

The vibration area is a pad or other area on the casing in vibratory contact with the vibrational source. As disclosed in more detail below, the vibrational source can be contained within the main housing volume of the casing. The placement of the vibrational source is variable so long as the vibration effects of vibrational source can be felt on the subject so as to produce vibrational vasodilation. The vibrational area can be proximal to thermal area. However, the vibrational area can coextend with the thermal area. The vibrational area in its simplest form is an area on the application area on the device 101 that allows the vibrations from vibrational source 131 to contact the subject.

Figure 10:
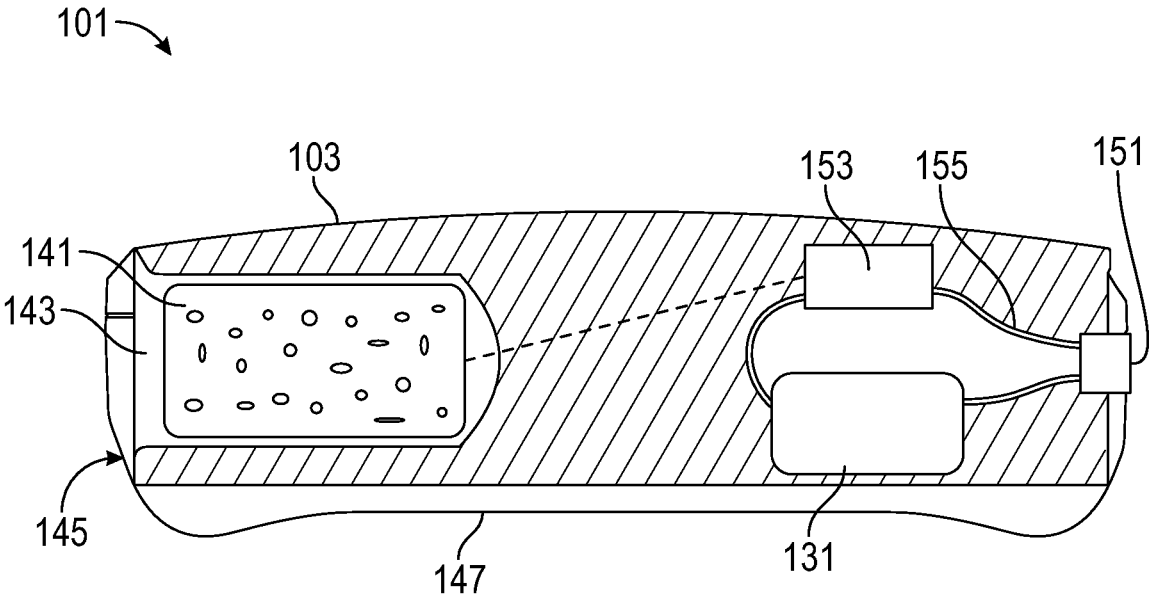
FIG. 10 is an internal view of an embodiment of the device.

Referring now to FIG. 10, an interior or sectional side view of the embodiment as shown along line A—of FIG. 8 is shown. The casing 103 is a generally hollow structure sized to contain a thermal element 141 and a vibrational source 131. Thermal element 141 can be placed within thermal element pocket 143 through an aperture or opening 145 and can be held within the thermal element pocket 143 by friction, adhesives, fasteners, or by a zipper or other type of closure on the opening 145. The bottom wall 147 of the thermal element pocket 143 can be sufficiently thin or have sufficient thermal transfer characteristics so as to allow the efficient transfer of cold or heat from thermal element 141 to the subject. The device 101 further comprises a power source 153 and wiring 155 electrically connecting vibrational source 131 and power source 154 to on/off switch 151.

The casing is a generally hollow structure sized to contain the thermal element and vibrational source. More specifically, casing can be a rigid hollow case having an interior volume or a flexible or pliant case having an interior volume. Such cases are known, as well as their materials and methods of construction. It is only important that casing be constructed such that casing can contain and hold a thermal element and a vibrational source in a predetermined position relative to the subject when applied to the subject.

The thermal element can be contained in a thermal element pocket. The thermal element can be placed within the thermal element pocket through a mouth or opening and can be held within the thermal element pocket by friction, adhesives, fasteners, or by a zipper or other type of closure on the pocket mouth or opening. The bottom wall of the thermal element pocket can be sufficiently thin or have sufficient thermal transfer characteristics so as to allow the efficient transfer of cold or heat from the thermal element to the subject.

The thermal element can be any thermal element capable of storing and transferring cold (removing heat). Illustrative examples of suitable thermal elements include metal ingots, low freezing point (below about 45° F. or 7.2° C.) liquids and gels, ceramics, polymers, other heat sinks, and even ice packs. Such thermal elements are known. It is only important that thermal element be able to transfer cold to the subject in a sufficient amount so as to produce the desired effect, for example vasodilation, pain reduction, itching sensation reduction, reduction in blocked vessels. For example, providing a temperature of below about 45° F. or 7.2° C., and between about 28° F. or −2.2° C. and about 54° F. or 12.2° C., between about 38° F. or 3.3° C. and about 45° F. or 7.2° C., or not greater than about 34° F., to the subject prior to and during the treatment method is sufficient to provide a suitable level of effective treatment. The thermal element is applied to the subject for a time period sufficient to initiate treatment, such as thermal vasodilation, which can be between 1 second and several minutes or more depending on the subject. For example, in some applications, it is desirable to apply the thermal element to the subject for a period of about 1 to 60 seconds, or longer, prior to initiating an activity, such as injecting a medication that causes a painful or burning sensation, or scraping of a wound, and continuing the application of the thermal effect and/or vibration during the activity to provide a suitable level of effective treatment by the device.

The thermal element may be any conventional thermal element capable of storing and transferring heat or cold. Illustrative examples of suitable thermal elements include high specific-heat capacity material like grains, such as wheat or buck wheat, sewn within an insulated fabric such as flannel, chemical thermal elements like calcium chloride- or supersaturated sodium acetate-based heat pads, or other conventional heat/cold packs. A thermal element may be a gel or other type of heat/cold pack that may be placed in a freezer or microwave and such heat/cold packs are known in the art. Embodiments contemplate use of thermal elements that are known in the art. The thermal element needs to transfer heat or cold to the subject in a sufficient amount so as to produce the desired effect of such heat or cold, for example vasoconstriction or vasodilation. One of skill in the art, such as medical personnel, or a subject, can determine an adequate temperature and time for application of the thermal element for methods disclosed herein. The thermal element is applied to the subject for a time period sufficient to cause the desired effect, which can be between 0 seconds and several minutes or more depending on the subject and/or the method. A second or third thermal element may be used in replacing a first thermal element used in a method, especially in methods where application of vibration and/or thermal effects continue for a longer time period than the first thermal element can maintain the desired temperature.

The vibrational source can be contained within the interior of the casing. Vibrational source can be placed within casing during manufacture or, if casing has an ingress and egress means, such as a zipper or other closure, at any time after manufacture. In an embodiment, an ingress and egress means can be provided for a battery so the battery can be changed on occasion. Vibrational source and power source can be held within casing by friction, adhesives, fasteners, or other types of securing means. Alternatively, the interior volume of casing can be approximately the same dimensions as the vibrational source, including the power source, such that additional means for securing the vibrational source 28 are unnecessary. The proximal side of the casing that is proximal to vibrational source can be sufficiently thin or have sufficient vibrational transfer characteristics so as to allow the efficient transfer of vibration from vibrational source to the application area of the casing and thus to the subject to be treated in the methods disclosed herein.

The vibrational source can be any vibrational source or means for producing vibrations. The vibrational source can further comprise a power source and wiring electrically connecting vibrational source and power source to an on/off switch. Illustrative examples of suitable vibrational sources include elliptical flywheel motors, eccentric motors, and the like. Such vibrational sources are known. It is only important that the vibrational source be able to transfer vibration to the subject at a sufficient level to produce the effect intended in the disclosed methods. For example, a device can provide vibrations of between about 180-250 Hz. The application area of the device which vibrates due to the action of the vibrational source is applied to the subject for a time period sufficient to accomplish the effect intended in the disclosed methods, which can be between 1 second and up to an hour or more depending on the subject and/or the method. For example, the application area of the casing may provide vibration to the subject for a period of 20 minutes for rehabilitation, or longer in certain methods, to accomplish the effect intended in the disclosed methods.

A switch may be a common switch and is used to turn the vibrational source on and off, namely to start and stop the vibration, respectively. The switch may also control power transmission to a control element or other element of the device, such as a sound element or a light. The switch can be secured to the casing at any convenient position where it may readily be actuated. The switch can be located at the anterior side of the device and is a push button switch. The switch is electrically connected in a known manner between the power source and the vibrational source to control the application of power to the vibrational source. In an aspect, when the vibrational source is switched on, the vibrating force produced from the vibrational source, such as the various types of motors disclosed above, will be transmitted through the casing to the contacted surface.

A switch can be a common on/off switch, such as a toggle, lever, push-button, capacitance or other switch. This type of switch would be practical with a single vibrational cycle motor. Alternatively, switch can be a common three-way switch. This type of switch would be practical with a double vibrational cycle motor. Alternatively, a switch can be a common potentiostat. This type of switch would be practical with a vibrational motor that operates at many different vibrational cycles along a continuum. The selection of the type of switch and the control element of a device is within the skill of those knowledgeable in the art. For example, a switch can turn power on or off to a control panel that in turn controls a vibration source, and/or other elements of the device, such as sound or light elements.

Figure 11:
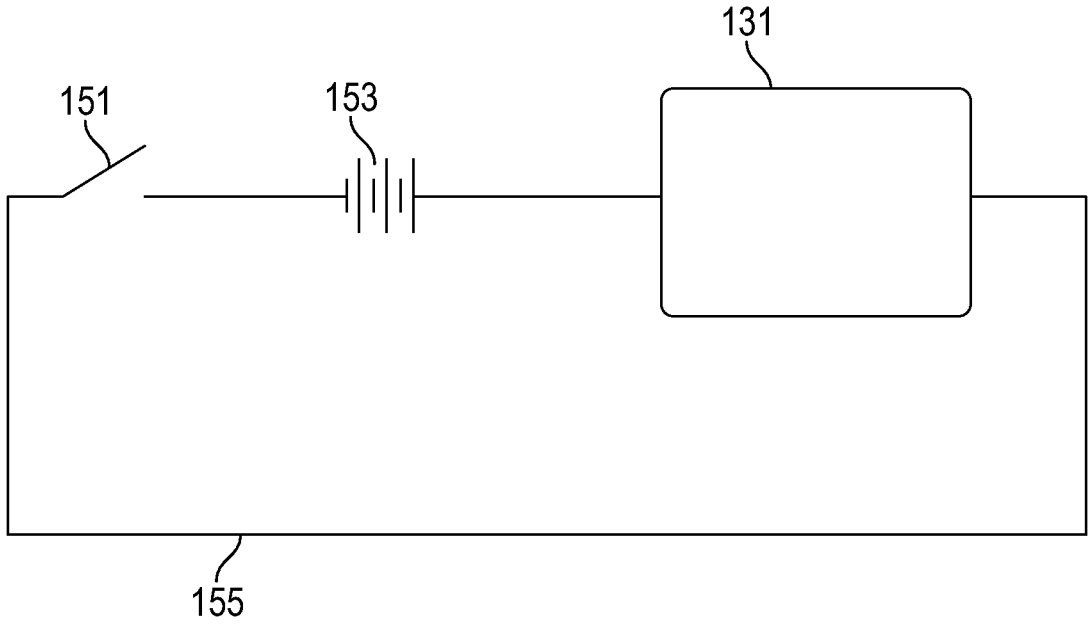
FIG. 11 is a schematic circuit diagram of an embodiment of the device.

Referring now to FIG. 11, a representative circuit diagram for the vibrational source 131 is shown. The vibrational source 131, power source 153, and on/off switch 151 can be electrically connected in series by wiring 155. The power source 153 illustrated is a battery; however, the power source 153 can be any type of power sources such as but not limited to a connection to an alternating current source (a wall plug), a solar or other light cell, a reactor, a mechanical source such as a flywheel or springs, or the like. It is only important that power source be able to provide sufficient power to vibrational source so as to produce sufficient vibration for effecting vibrational vasodilation.

In operation and use, a device is effective in achieving the methods disclosed herein. According to known gate theory, vibration helps to reduce pain as the vibrational or motion nerves surmount the pain nerves. Similarly, it is known that cold helps to reduce pain as the temperature nerves surmount the pain nerves, and heat reduces chronic pain and catastrophizing as well as reducing cramping locally. It also is known that warm thermal contact is effective at vasodilation. It also is known that vibrational and thermal vasodilation is more effective when applied generally between the pain source or vasoconstricted site and the brain, and more specifically close to the nerve plexi where the various nerve types (pain, temperature and motion) converge in the body, generally at or proximal to a joint.

A thermal element is cooled or heated, as necessary. For example, if the thermal element is a metal ingot or low freezing point gel, the thermal element is placed in a refrigerator, freezer, or other cold site. Alternatively, if the thermal element is a high specific-heat capacity material like a grain sewn within an insulated fabric it may be microwaved before use to heat it. When the thermal element is of a satisfactory temperature, the thermal element is placed within or adjacent to the casing. The thermal element may be placed within the thermal element pocket, within an elastic band attached to the casing so that the thermal element is interposed between the elastic band and the proximal side of the device, or within a clip located on the proximal side of the device. The device is contacted to the surface, such as the surface of skin of a subject, at the desired location, depending on the method employed for the desired treatment. In the example shown in FIG. 1, where a site of injection is proximal to the subject's wrist, the device is contacted between the injection site and the subject's brain, and more specifically in the illustrative example shown in FIG. 7, is placed between the injection site and the subject's elbow and proximal to the nerve plexi proximal to the elbow. In other methods, the device may contact the site directly and not be adjacent to it, as described for certain disclosed methods.

The application area of the device, with the thermal element interposed therebetween, is applied to the selected area of the subject such that the application area, comprising the thermal area and the vibrational area, contact the subject's skin. The thermal element may be contacted with the surface for a time period, without vibration, for example, tallow the thermal element to act upon the subject for a suitable time period so as to initiate thermal effects, for example, vasodilation or vasoconstriction. Alternatively, concurrently with application of the thermal element to achieve thermal effects, the vibrational source is actuated, for example, by the switch, creating vibration, which is transferred through the application area (and through the thermal element if present) to the contacted surface. The vibrational source also is allowed to act upon the subject for a suitable time period so as to initiate the desired effect depending on the method of application. After thermal and vibrational effects are initiated, a treatment may occur for the subject or the vibrational and thermal effects may be continued until pain or itching sensations are no longer perceived by the subject.

Once the desired treatment is completed, vessel diameters have been effected, or the sensations are no longer perceived by the subject, the entire device can be removed from contacting the surface, and/or only the thermal element can be removed and the device continues to provide vibration to the surface, or the thermal element may remain in place on the surface and the vibrational source may be turned off. In one illustrative method, the device is left in contact with the subject for a period 20 minutes.

Thus, in one of its simplest forms, the device can provide vibration with or without thermal treatment to a surface, comprising a compressive attachment mechanism, a casing comprising an application area, wherein at least a portion of the application area is shaped to substantially contact a surface, such as a subject's skin, a vibrational source contained within the casing, with said vibrational source capable of producing vibration that is transfer through the casing to at least the surface, and optionally comprising a thermal element capable of transmitting heat or cold. The application area is constructed to allow the transmission of vibration from the vibrational source to the surface, such as a subject's skin, and by the interpositioning of a thermal source between the application area and the surface, providing thermal effects to the surface. The vibration or combination of the vibration and transmission of cold or heat from the thermal element produces vibrational and thermal effects on the subject.

Embodiments can further include the use of a removable thermal element. For example, the casing may comprise a flat hook on which a thermal pack could be attached while still transmitting vibrational energy if the pack were soft.

The images depict various embodiments of how a device can be strapped or inserted into or under a strap or brace. The user can use the device and stroke portions of the device on fascia to treat it.

The embodiments disclosed herein add vibration of to the angulated edge of a powered device. The body of every patient or user has mechanoreceptors that are responsible for controlling pain and their recovery is improved with vibration. The deep pressure exerted by the angulated edge together in combination with the appropriate, high frequency vibration significantly enhance the management of pain, increase of movement and improve overall function.

As the combination of soft tissue mobilization and vibration is a stimulatory effect on the neurological system, possible uses for this combination could be used in neuro instruction techniques that are coming to physical therapy. Example, using these embodiments with the angulated edge to be used to improve a squat when someone is limited by pain and fascial restrictions.

In some examples, specific frequencies to stimulate Pacinian corpuscles can be used. Versions also can increase blood or fluid flow in local areas. An embodiment of a device comprises a strap or brace, such as a compressive circumferential strap. These can range from an elastic band that will press the vibrational source, to a larger compressive wrap that secures the vibratory device to a limb or body structure. There is a casing that contains a vibrational source, either built in or removable to the compressive strap, and an on/off switch for the vibrational source. A device may further comprise an attachment element for holding a thermal element in association with the casing. An attachment element may be an integral portion of the casing, or may be itself attached to the casing. Further, a strap can act as a tourniquet, if necessary. Alternatively, the device can be held against the subject by the practitioner, the practitioner's assistant, or the subject.

A casing of a device comprises an application area that comprises an optional thermal area and a vibrational area. The application area is the portion of the casing for contacting the surface or for contacting a thermal element that in turn contacts the surface. For simplicity of understanding, the surface may be referred to as the skin of a subject. In an aspect, the application area may be all or a portion of the proximal side of a vibratory device. A thermal element cooperates with the thermal area to apply cold or heat to the subject, and a vibrational source cooperates with the vibrational area to apply vibration to the subject. The placement of the thermal element is variable so long as the effects of the thermal element can be felt on the subject so as to produce thermal vasodilation or vasoconstriction. The placement of the vibrational source in the casing is variable so long as the vibrational effects of the vibrational source can be felt on the subject so as to produce vibrational vasodilation or is effective in stimulating nerves so that a pain or sensation message is blocked or interfered with in reaching the spinal cord nerves, and interfering with the perception of the pain or sensation by the subject. The casing can be a generally hollow structure sized to contain thermal element at least the vibrational source, its control elements and power elements, such as batteries. A clip, band, adhesive or hook on the proximal side, facing the subject surface, may be used to secure the optional thermal element while maintaining contact with the vibrational source. A mechanism, such as adhesive, an elastic band or hook, also may be used to secure the thermal element to the proximal side of a device. A casing may further contain a control element for controlling the speed of vibration or period of vibration, for storing and providing sound, for providing a timing element, for controlling a light.

A casing may further comprise on opening through the casing for providing an amplifier on the outer surface of the casing that is connected to a control element or a sound element contained within the casing. A casing may further comprise on opening through the casing for providing a light, such as an LED light, on the outer surface of the casing that is connected to a control element or a timing element contained within the casing. A light (and/or sound) may be turned on when vibration is initiated and turned off when power to the vibration element is turned off. Alternatively, powering on the vibration element may also power on a timing element, and optionally a light (and/or sound), so that when a desired time period has occurred, the timing element may turn off the light (and/or sound), or may turn off a light (and/or sound) and the vibration element. Alternatively, the timing element may be under control that is separate from the vibration element. Components for switches, control elements, timing elements, sound elements and lights are known. Wires for connecting the elements within the casing or on the surface are contemplated herein.

The casing may be shaped to provide an application area that is in contact with a surface so that substantially all of the application area contacts the surface. For example, a casing may be flat or concave in shape so that the application area is shaped so that substantially all of the proximal side of the casing contacts the surface of the surface. When a thermal element is placed on the proximal surface of the casing, substantially all of the proximal side contacts the thermal element interposed between the casing and the surface so that an area of the surface that is equivalent to the area of substantially all of the proximal side of the casing is contacted by the thermal element and receives vibrational effects there through. All or a portion of a casing may be curved. For example, the entire casing may be curved, such as in a concave direction (curved like the interior of a circle), so that the proximal side of the casing is contacting a surface through all or a portion of its surface (or the thermal element interposed there between) and the distal side of the casing is curved to mirror the curve of the proximal side, so as to be comfortably held by a hand or held in place by a strap. Alternatively, only one surface, either the distal or proximal side may be curved, for example, where the proximal side is curved, but the distal side is planar. Additionally, the lateral sides of the casing may be shaped, for example, as shown in the figures, there may be an indented area in the lateral sides. The lateral sides of the casing may be shaped in any form desired.

The vibrational source can be any conventional vibrational source or means for producing high frequency low amplitude vibrations. The on/off switch can be a common switch or a push button on/off switch, and is used to turn the vibrational source on and off. The power source for operating the vibrational source can be any type of power source such as but not limited to a connection to an alternating current source (a wall plug), a solar or other light cell, a miniature reactor, a mechanical source such as a flywheel or springs, a disposable or rechargeable battery or the like.

Embodiments comprise methods comprising use of a device disclosed herein for increasing local blood flow. A method comprises contacting a device to a site of restricted fluid flow, for example, to a site of small arteries or veins, vessel spasm or vasospasm, or a site of blocked or restricted lymph or duct flow, initiating vibration and/or thermal effects, for a time sufficient to effect an increase in the diameter of the vessels, such as blood vessels, such as veins and/or arteries, lymph vessels, and ducts.

A method comprises reducing the pain or burning sensation caused by surgery. A method of reducing the pain after surgery comprises a) contacting a device with an area on the surface of a subject between the spinal cord and the site of surgery, or directly over bandages; b) initiating vibration by the device, and optionally applying a thermal effect simultaneously with the vibration; c) using a thermal pack that is solid, with dissipation of either heat or cold to limit risk of tissue damage from prolonged heat or cold d) continuing vibration and/or thermal effect at the injection site for a time sufficient to reduce the pain felt from the surgical site or related muscle spasms secondary to surgery. The device may interfere with transmission of pain signals by aDelta nerves. The vibration is provided for a desired period, such as until the perception of pain is minimal. A medical provider or a user of the device can determine which type of vibration to use and how long to contact the device and/or the thermal element to the skin surface.

A method comprises treating pain during medical cleaning or scraping of an open wound, scrape, or burn. When the structure of the skin is disturbed by a scrape, such as a rough abrasion of the skin due to a fall on a rough surface or rubbing against a surface such as in a motorcycle accident, many pain signals are sent to the brain. A method of interfering with transmission of pain signals caused by a scrape comprises a) contacting a device with an area on the surface of a subject between the spinal cord and the site of the scrape, so that at least a portion of the application area of the device contacts the area; b) initiating vibration by the device, and optionally applying a thermal effect simultaneously with the vibration, by interposing a thermal element between the application area of the device and the contacted surface; and c) providing vibrating and/or thermal effect for a sufficient time to interfere with nerve transmission to the brain, and to reduce the pain felt from the wound.

A method comprises treating pain from phantom pain from a missing limb (e.g., neuropathic pain) can comprise a) contacting a device with an area on the surface of a subject between the spinal cord and the site of nerve pain or in the case of missing limbs, at the stump or terminus of the limb, so that at least a portion of the application area of the device contacts a portion of the area; b) initiating vibration by the device, and optionally applying a thermal effect simultaneously with the vibration, by interposing a thermal element between the application area of the device and the contacted surface; and c) continuing vibration and/or thermal effect at the site of for a time sufficient to reduce the pain felt from the site. The thermal effect may cold or warm. The device may interfere with transmission of pain signals by aDelta nerves at the site.

The thermal element is cooled or heated, if necessary to within a predetermined temperature range. The thermal element may be placed within or attached to the casing. Alternatively, if the device is made to certain standards, the entire device already containing a thermal element can be cooled to the desired temperature. When a subject anticipates a need for a treatment using the device, the device is applied to the body at a desired location, such at the site to be treated or at a site proximate to a pain site and between the pain site and the brain and/or spinal cord, as described for treatments disclosed herein.

"Thermal vasodilation" or "thermal dilation" as used herein includes, but is not limited to, the use or application of cold or reduced temperature (or the removal of heat) or warm packs or heat to a subject to induce an effect of increased vascular diameter and increased arterial or venous blood flow.

"Vibrational vasodilation" or "vibrational dilation" as used herein includes, but is not limited to, the use or application of vibration to a subject to induce an increase in vascular diameter and increased blood flow from arteries, veins, or capillaries.

"Vibrational and thermal vasodilation" as used herein includes, but is not limit to, the use or application of either heat or cold or reduced temperature (or the removal of heat) concurrently, substantially concurrently, or sequentially with the use or application of vibration to a subject to induce a vasodilatory effect.

As used herein, subject means a human or animal, comprising any living animal. In addition, the content of U.S. patent application Ser. No. 16/115,484 to Baxter, et al, filed Aug. 28, 2018, is incorporated herein by reference in its entirety.

Other embodiments can include one or more of the following items.

1. A device for treating a user, comprising:
   - a housing having apertures and a plurality of application areas comprising a convex top surface, a concave bottom surface, a convex rear surface, convex side surfaces and rounded protrusions extending away from the housing;
   - a vibrational source in the housing and configured to produce vibration at the plurality of application areas; and
   - a switch in operative communication with the vibrational source to control operation of the vibrational source.

2. The device further comprising a strap configured to be woven through the apertures in the housing for restraint of the device and attachment of the device to the user.

3. The device further comprising a brace configured to be woven through the apertures of two of the devices that are identical to each other, the brace is configured to support both of the devices and mounted to the user.

4. The device wherein each of the plurality of application areas allows simultaneous transfer of both vibration and thermal effects to a site of the user; and a combination of vibration and thermal effects are configured to produce a vibrational analgesia and a thermal analgesia treatment that are effective to do at least one of:

reduce pain associated with the site of the user, improve a wound associated with the site of the user, or enhance healing associated with the site of the user.

5. The device wherein the housing comprises a uniform, thermally conductive and rigid material, the plurality of application areas of the housing further comprise four sides with rounded corners, and the rounded protrusions extend from a bottom of the housing and extend to the rounded corners of the housing.

6. The device further comprising a thermal element is located inside the housing, and the switch is in operative communication with the thermal element to control operation of the thermal element.

7. The device wherein the thermal element comprises at least one of a Peltier cooler, thermoelectric heat pump, thermoelectric cooler, Peltier heater or electric heating element, and the device is configured to initiate at least one thermal effect by activating the thermal element by using the switch.

8. The device wherein:

the switch comprises a wireless device having application software configured to transmit instructions regarding operation of the device; and the application software operates to perform at least one of:

present information regarding operation of the device to the user via a graphic user interface on the wireless device;

receive instructions regarding operation of the device from the user; or transmit instructions to the device.

9. The device wherein operation of the device comprises selection of a vibration parameter comprising at least one of a continuous vibration cycle, an intermittent vibration cycle, a frequency of vibration or an amplitude of vibration;

the vibration frequency is in a range of about 30 Hertz (Hz) to about 60 Hz for delayed onset muscle soreness, about 100 Hz to about 300 Hz for muscle recovery and muscle mass, and about 180 Hz to about 250 Hz for pain; and the vibration amplitude is in a range of about 0.2 Newtons (N) to about 3.0 N.

10. The device wherein each of the plurality of application areas is configured to perform a different technique of instrument assisted soft tissue mobilization (IASTM) on fascia of the user, comprising:

the device comprises rounded, convex corners, and each corner is for a first type of IASTM comprising concentrated mechanical stimulation at myofascial trigger points procedures;

the rounded protrusions are for a second type of IASTM comprising lymphatic drainage procedures;

the convex top surface is for a third type of IASTM comprising concentrated mechanical stimulation of the body of a spasmed muscle procedures;

the concave bottom surface is for a fourth type of IASTM comprising activating muscle during motion procedures, reducing pain with a brace, improving range of motion and improving range of motion with a brace; and the concave rear surface of the device is opposite the switch and also provides a second type of IASTM for lymphatic drainage procedures.

11. A device for treating a user, comprising:

a housing having apertures and a plurality of application areas comprising a convex top surface, a concave bottom surface, a convex rear surface, convex side surfaces and rounded protrusions extending away from the housing;

a vibrational source in the housing and configured to produce vibration at the plurality of application areas;

a thermal element in the housing and configured to produce thermal effects that can be hot or cold at the plurality of application areas; and a switch in operative communication with the vibrational source for controlling operation of the vibrational source, and with the thermal element for controlling operation of the thermal element.

12. The device further comprising a strap configured to be woven through the apertures in the housing for restraint of the device and attachment of the device to the user.

13. The device wherein each of the plurality of application areas allows simultaneous transfer of both vibration and thermal effects to a site of the user; and a combination of vibration and thermal effects are configured to produce a vibrational analgesia and a thermal analgesia treatment that are effective to do at least one of:

reduce pain associated with the site of the user, improve a wound associated with the site of the user, or enhance healing associated with the site of the user.

14. The device wherein the housing comprises a uniform, thermally conductive and rigid material, the plurality of application areas of the housing further comprise four sides with rounded corners, and the rounded protrusions extend from a bottom of the housing and extend to the rounded corners of the housing.

15. The device wherein the thermal element comprises at least one of a Peltier cooler, thermoelectric heat pump, thermoelectric cooler, Peltier heater or electric heating element, and the device is configured to initiate at least one thermal effect by activating the thermal element by using the switch.

16. The device wherein:

the switch comprises a wireless device having application software configured to transmit instructions regarding operation of the device; and the application software operates to perform at least one of:

present information regarding operation of the device to the user via a graphic user interface on the wireless device;

receive instructions regarding operation of the device from the user; or transmit instructions to the device.

17. The device wherein operation of the device comprises selection of a vibration parameter comprising at least one of a continuous vibration cycle, an intermittent vibration cycle, a frequency of vibration or an amplitude of vibration;

the vibration frequency is in a range of about 30 Hertz (Hz) to about 60 Hz for delayed onset muscle soreness, about 100 Hz to about 300 Hz for muscle recovery and muscle mass, and about 180 Hz to about 250 Hz for pain; and the vibration amplitude is in a range of about 0.2 Newtons (N) to about 3.0 N.

18. The device wherein each of the plurality of application areas is configured to perform a different technique of instrument assisted soft tissue mobilization (IASTM) on fascia of the user, comprising:

the device comprises rounded, convex corners, and each corner is for a first type of IASTM comprising concentrated mechanical stimulation at myofascial trigger points procedures;

the rounded protrusions are for a second type of IASTM comprising lymphatic drainage procedures;

the convex top surface is for a third type of IASTM comprising concentrated mechanical stimulation of the body of a spasmed muscle procedures;

the concave bottom surface is for a fourth type of IASTM comprising activating muscle during motion procedures, reducing pain with a brace, improving range of motion and improving range of motion with a brace; and the concave rear surface of the device is opposite the switch and also provides a second type of IASTM for lymphatic drainage procedures.

19. A method of relieving pain or improving procedural success by improving blood flow of a user, the method comprising:

(a) providing a device comprising a housing having a plurality of application areas for contacting skin of the user either directly or non-directly through a vibration and thermal non-insulating interface;

(b) applying vibration to the user with the device;

(c) providing thermal treatment to the user while the device is vibrating;

(d) maintaining steps (b) and (c) for a time period and producing a vasodilation effect on the user to relieve pain of the user or enhance blood flow in the user; and steps (b) through (d) occur with the device mounted to a restraint that permits passage of vibration and thermal treatment to the user.

20. The method wherein step (c) cools the skin of the user to a temperature of at least about 45° F.

21. The method wherein step (c) warms the skin of the user to a temperature in a range of about 100° F. to about 120° F.

22. The method wherein step (b) comprises vibrating in a range of about 30 Hz to about 60 Hz for delayed onset muscle soreness of the user, or in a range of about 100 Hz to about 300 Hz for muscle recovery and muscle mass of the user, or in a range of about 180 Hz to about 250 Hz for pain of the user.

23. The method further comprising placing the device on the skin of the user at a position where pain from decreased blood flow will occur and a head of the user, and moving the device along a nerve path of the user.

24. The method further comprising placing and moving the device on the skin of the user at a position proximal to a nerve plexi on the user. Benefits, other advantages, and solutions to problems have been described above with regard to specific embodiments. However, the benefits, advantages, solutions to problems, and any feature(s) that can cause any benefit, advantage, or solution to occur or become more pronounced are not to be construed as a critical, required, sacrosanct or essential feature of any or all the claims.

After reading the specification, skilled artisans will appreciate that certain features which, for clarity, are described herein in the context of separate embodiments, can also be provided in combination in a single embodiment. Conversely, various features that are, for brevity, described in the context of a single embodiment, can also be provided separately or in any subcombination. Further, references to values stated in ranges include each and every possible value within that range.

REFERENCES

Each of the following references is incorporated herein by reference in its entirety.

1 Charcot J-M. La medicine vibratoire—Application des vibrations rapides et continues a traitment de quelques maladies du systeme nerveux. Prog Med. 1892; 16:149-51.

2 Whedon G D, Deitrick J E, Shorr E. Modification of the effects of immobilization upon metabolic and physiologic functions of normal men by the use of an oscillating bed. The American journal of medicine. 1949 June; 6(6):684-711.

3 Mendell L M. Constructing and deconstructing the gate theory of pain. Pain. 2014 February; 155(2):210-6.

4 Melzack R, Wall P D. Pain mechanisms: a new theory. Science. 1965 Nov. 19; 150(699):971-9.

5 Knibestol M, Vallbo A B. Single unit analysis of mechanoreceptor activity from the human glabrous skin. Acta Physiol Scand. 1970 October; 80(2):178-95.

6 Macefield V G. Physiological characteristics of low-threshold mechanoreceptors in joints, muscle and skin in human subjects. Clinical and experimental pharmacology & physiology. 2005 January-February; 32(1-2): 135-44.

7 Freeman A W, Johnson K O. Cutaneous mechanoreceptors in macaque monkey: temporal discharge patterns evoked by vibration, and a receptor model. J Physiol. 1982 February; 323:21-41.

8 Muniak M A, Ray S, Hsiao S S, Dammann J F, Bensmaia S J. The neural coding of stimulus intensity: linking the population response of mechanoreceptive afferents with psychophysical behavior. The Journal of neuroscience: the official journal of the Society for Neuroscience. 2007 Oct. 24; 27(43): 11687-99.

9 Manfredi L R, Baker A T, Elias D O, et al. The effect of surface wave propagation on neural responses to vibration in primate glabrous skin. PloS one. 2012; 7(2):e31203.

10 Giunta M, Cardinale M, Agosti F, et al. Growth hormone-releasing effects of whole body vibration alone or combined with squatting plus external load in severely obese female subjects. Obesity facts. 2012; 5(4):567-74.

11 Cardinale M, Wakeling J. Whole body vibration exercise: are vibrations good for you? British journal of sports medicine. 2005 September; 39(9):585-9; discussion 9.

12 Nigg B M, Wakeling J M. Impact forces and muscle tuning: a new paradigm. Exercise and sport sciences reviews. 2001; 29(1):37-41.

13 Bilgin H M, Celik F, Gem M, et al. Effects of local vibration and pulsed electromagnetic field on bone fracture: A comparative study. Bioelectromagnetics. 2017 July; 38(5):339-48.

14 Imtiyaz S, Veqar Z, Shareef M Y. To Compare the Effect of Vibration Therapy and Massage in Prevention of Delayed Onset Muscle Soreness (DOMS). Journal of clinical and diagnostic research: JCDR. 2014 January; 8(1):133-6.

15 Veqar Z, Imtiyaz S. Vibration Therapy in Management of Delayed Onset Muscle Soreness (DOMS). Journal of clinical and diagnostic research: JCDR. 2014 June; 8(6): Le01-4.

16 Benedetti M G, Boccia G, Cavazzuti L, et al. Localized muscle vibration reverses quadriceps muscle hypotrophy and improves physical function: a clinical and electrophysiological study. International journal of rehabilitation research Internationale Zeitschrift fur Rehabilitationsforschung Revue internationale de recherches de readaptation. 2017 December; 40(4):339-46.

17 Bakhtiary A H, Fatemi E, Khalili M A, Ghorbani R. Localised application of vibration improves passive knee extension in women with apparent reduced hamstring extensibility: a randomised trial. Journal of physiotherapy. 2011; 57(3):165-71.

18 Brunetti O, Botti F M, Roscini M, et al. Focal vibration of quadriceps muscle enhances leg power and decreases knee joint laxity in female volleyball players. The Journal of sports medicine and physical fitness. 2012 December; 52(6):596-605.

19 Lam P H, Hansen K, Keighley G, Hackett L, Murrell G A. A Randomized, Double-Blinded, Placebo-Controlled Clinical Trial Evaluating the Effectiveness of Daily Vibration After Arthroscopic Rotator Cuff Repair. The American journal of sports medicine. 2015 November; 43(11): 2774-82.

20 Imai R, Osumi M, Ishigaki T, Morioka S. Effect of illusory kinesthesia on hand function in patients with distal radius fractures: a quasi-randomized controlled study. Clinical rehabilitation. 2017 May; 31(5): 696-701.

21 Broadbent S, Rousseau J J, Thorp R M, Choate S L, Jackson F S, Rowlands D S. Vibration therapy reduces plasma IL6 and muscle soreness after downhill running British journal of sports medicine. 2010 September; 44(12):888-94.

22 Bianconi R, van der M J. The response to vibration of the end organs of mammalian muscle spindles. Journal of neurophysiology. 1963 January; 26:177-90.

23 Guang H, Ji L, Shi Y. Focal Vibration Stretches Muscle Fibers by Producing Muscle Waves. IEEE transactions on neural systems and rehabilitation engineering: a publication of the IEEE Engineering in Medicine and Biology Society. 2018 April; 26(4):839-46.

24 Staud R, Robinson M E, Vierck C J, Jr., Price D D. Diffuse noxious inhibitory controls (DNIC) attenuate temporal summation of second pain in normal males but not in normal females or fibromyalgia patients. Pain. 2003 January; 101(1-2):167-74.

25 Malanga G A, Yan N, Stark J. Mechanisms and efficacy of heat and cold therapies for musculoskeletal injury. Postgraduate medicine. 2015 January; 127(1):57-65.

26 Staud R, Robinson M E, Goldman C T, Price D D. Attenuation of experimental pain by vibro-tactile stimulation in patients with chronic local or widespread musculoskeletal pain. European journal of pain (London, England). 2011 September; 15(8):836-42.

27 Harper D E, Hollins M. Is touch gating due to sensory or cognitive interference? Pain. 2012 May; 153(5): 1082-90.

28 Hollins M, McDermott K, Harper D. How does vibration reduce pain? Perception. 2014; 43(1):70-84.

29 Skoglund C R. Vasodilatation in human skin induced by low-amplitude high-frequency vibration. Clin Physiol. 1989 August; 9(4):361-72.

30 Pastouret F, Cardozo L, Lamote J, Buyl R, Lievens P. Effects of Multidirectional Vibrations Delivered in a Horizontal Position (Andullation®) on Blood Microcirculation in Laboratory Animals: A Preliminary Study. Medical science monitor basic research. 2016 Oct. 14; 22:115-22.

31 Schneider R. Low-frequency vibrotherapy considerably improves the effectiveness of manual lymphatic drainage (MLD) in patients with lipedema: A two-armed, randomized, controlled pragmatic trial. Physiotherapy theory and practice. 2020 January; 36(1):63-70.

32 Celletti C, Fara M A, Filippi G M, et al. Focal Muscle Vibration and Physical Exercise in Postmastectomy Recovery: An Explorative Study. BioMed research international. 2017; 2017:7302892.

33 Schneider R. Effectiveness of myofascial trigger point therapy in chronic back pain patients is considerably increased when combined with a new, integrated, low-frequency shock wave vibrotherapy (Cellconnect Impulse): A two-armed, measurement repeated, randomized, controlled pragmatic trial. Journal of back and musculoskeletal rehabilitation. 2018 Feb. 6; 31(1):57-64.

34 Murillo N, Valls-Sole J, Vidal J, Opisso E, Medina J, Kumru H. Focal vibration in neurorehabilitation. European journal of physical and rehabilitation medicine. 2014 April; 50(2):231-42.

35 Costantino C, Galuppo L, Romiti D. Short-term effect of local muscle vibration treatment versus sham therapy on upper limb in chronic post-stroke patients: a randomized controlled trial. European journal of physical and rehabilitation medicine. 2017 February; 53(1):32-40.

36 Khalifeloo M, Naghdi S, Ansari N N, et al. A study on the immediate effects of plantar vibration on balance dysfunction in patients with stroke. Journal of exercise rehabilitation. 2018 April; 14(2):259-66.

What is claimed is:

1. A device for treating a user, comprising:

a housing having apertures extending longitudinally and a plurality of application areas comprising a convex top surface, a concave bottom surface, a convex rear surface, convex side surfaces, rounded convex corners, and consisting of four rounded protrusions including a pair of front rounded protrusions and a pair of rear rounded protrusions each extending away from the housing;

the housing extending longitudinally from a front surface to the convex rear surface, laterally between the convex side surfaces each connecting the front surface and the convex rear surface to define the rounded convex corners, and vertically between the convex top surface and the concave bottom surface;

the concave bottom surface being concave both longitudinally and laterally and defining a bottom apex equally spaced laterally between the convex side surfaces and longitudinally between the front surface and the convex rear surface, and the convex side surfaces each extend vertically beyond and away from the bottom apex;

each one of the pair of front rounded protrusions laterally and longitudinally ramping vertically away from the concave bottom surface of the housing and continuously increasing in height toward the rounded convex corners while wrapping around the rounded convex corners adjacent the front surface;

each one of the pair of rear rounded protrusions laterally and longitudinally ramping vertically away from the concave bottom surface of the housing and continuously increasing in height toward the rounded convex corners while wrapping around the rounded convex corners adjacent the convex rear surface;

a vibrational source in the housing and configured to produce vibration at the plurality of application areas; and a switch in operative communication with the vibrational source to control operation of the vibrational source.

2. The device of claim 1, further comprising a strap configured to be woven through the apertures in the housing for restraint of the device or attachment of the device to the user.

3. The device of claim 1, further comprising a brace configured to be woven through the apertures of the device and apertures of a second device identical to the device, the brace being configured to support both of the device and the second device and be mounted to the user.

4. The device of claim 1, wherein each of the plurality of application areas allows simultaneous transfer of both vibration and thermal effects to a site of the user; and a combination of vibration and thermal effects are configured to produce a vibrational analgesia and a thermal analgesia treatment that are effective to do at least one of:

reduce pain associated with the site of the user, improve a wound associated with the site of the user, or enhance healing associated with the site of the user.

5. The device of claim 1, wherein the rounded protrusions increase a concavity of the concave bottom surface laterally at each of the front surface and the convex rear surface relative to the concavity of the bottom surface in between the front surface and the convex rear surface.

6. The device of claim 1, further comprising a thermal element located inside the housing, and the switch is in operative communication with the thermal element to control operation of the thermal element.

7. The device of claim 6, wherein the thermal element comprises at least one of a Peltier cooler, thermoelectric heat pump, thermoelectric cooler, Peltier heater or electric heating element, and the device is configured to initiate at least one thermal effect by activating the thermal element by using the switch.

8. The device of claim 1, wherein:

the switch comprises a wireless device having application software configured to transmit instructions regarding operation of the device; and the application software operates to perform at least one of:

present information regarding operation of the device to the user via a graphic user interface on the wireless device;

receive instructions regarding operation of the device from the user; or transmit instructions to the device.

9. The device of claim 1, wherein operation of the device comprises selection of a vibration parameter comprising at least one of a continuous vibration cycle, an intermittent vibration cycle, a frequency of vibration or an amplitude of vibration;

the vibration frequency is in a range of about 30 Hertz (Hz) to about 60 Hz for delayed onset muscle soreness, about 100 Hz to about 300 Hz for muscle recovery and muscle mass, and about 180 Hz to about 250 Hz for pain; and the vibration amplitude is in a range of about 0.2 Newtons (N) to about 3.0 N.

10. The device of claim 5, wherein each of the plurality of application areas is configured to perform a different technique of instrument assisted soft tissue mobilization (IASTM) on fascia of the user selected from the group consisting of a first type of IASTM comprising concentrated mechanical stimulation at myofascial trigger points procedures, a second type of IASTM comprising lymphatic drainage procedures, a third type of IASTM comprising concentrated mechanical stimulation of the body of a spasmed muscle procedures, and a fourth type of IASTM comprising activating muscle during motion procedures, reducing pain with a brace, improving range of motion and improving range of motion with the brace, wherein:

each of the rounded convex corners is configured for the first type of IASTM;

the rounded protrusions are configured for the second type of IASTM;

the convex top surface is configured for the third type of IASTM;

the concave bottom surface is configured for the fourth type of IASTM; and the convex rear surface of the device is opposite the switch and also configured for the second type of IASTM.

11. A device for treating a user, comprising:

a housing having apertures extending longitudinally and a plurality of application areas comprising a convex top surface, a concave bottom surface, a convex rear surface, convex side surfaces, rounded convex corners, and consisting of rounded protrusions only at the rounded convex corners of the housing, including a pair of front rounded protrusions and a pair of rear rounded protrusions each extending away from the concave bottom surface of the housing;

the housing extending longitudinally from a front surface to the convex rear surface, laterally between the convex side surfaces each connecting the front surface and the convex rear surface to define the rounded convex corners, and vertically between the convex top surface and the concave bottom surface;

the concave bottom surface being concave both longitudinally and laterally, and defining a bottom apex equally spaced laterally between the convex side surfaces, the convex side surfaces each extending vertically beyond and away from the apex;

each one of the pair of front rounded protrusions laterally and longitudinally ramping vertically away from the concave bottom surface of the housing and continuously increasing in height toward the rounded convex corners while wrapping around the rounded convex corners adjacent the front surface;

each one of the pair of rear rounded protrusions laterally and longitudinally ramping vertically away from the concave bottom surface of the housing and continuously increasing in height toward the rounded convex corners while wrapping around the rounded convex corners adjacent the convex rear surface;

a vibrational source in the housing and configured to produce vibration at the plurality of application areas; and a switch in operative communication with the vibrational source for controlling operation of the vibrational source;

operation of the device comprises selection of a vibration parameter comprising an amplitude of vibration, and the vibration amplitude is in a range of about 0.2 Newtons (N) to about 3.0 N; and each of the plurality of application areas is configured to perform a different technique of instrument assisted soft tissue mobilization (IASTM) on fascia of the user selected from the group consisting of a first type of IASTM comprising concentrated mechanical stimulation at myofascial trigger points procedures, a second type of IASTM comprising lymphatic drainage procedures, a third type of IASTM comprising concentrated mechanical stimulation of the body of a spasmed muscle procedures, and a fourth type of IASTM comprising activating muscle during motion procedures, reducing pain with a brace, improving range of motion and improving range of motion with the brace, wherein:

each of the rounded convex corners is configured for the first type of IASTM;

the rounded protrusions are configured for the second type of IASTM;

the convex top surface is configured for the third type of IASTM;

the concave bottom surface is configured for the fourth type of IASTM; and the convex rear surface of the device is opposite the switch and also configured for the second type of IASTM.

12. The device of claim 11, further comprising a strap configured to be woven through the apertures in the housing for restraint of the device and attachment of the device to the user.

13. The device of claim 11, wherein each of the plurality of application areas allows simultaneous transfer of both vibration and thermal effects to a site of the user; and a combination of vibration and thermal effects are configured to produce a vibrational analgesia and a thermal analgesia treatment that are effective to do at least one of:

reduce pain associated with the site of the user, improve a wound associated with the site of the user, or enhance healing associated with the site of the user.

14. The device of claim 11, wherein the rounded protrusions increase a concavity of the concave bottom surface laterally at each of the front surface and the convex rear surface relative to the concavity of the bottom surface in between the front surface and the convex rear surface.

15. The device of claim 11, wherein the thermal element comprises at least one of a Peltier cooler, thermoelectric heat pump, thermoelectric cooler, Peltier heater or electric heating element, and the device is configured to initiate at least one thermal effect by activating the thermal element by using the switch.

16. The device of claim 11, wherein:

the switch comprises a wireless device having application software configured to transmit instructions regarding operation of the device; and the application software operates to perform at least one of:

present information regarding operation of the device to the user via a graphic user interface on the wireless device;

receive instructions regarding operation of the device from the user; or transmit instructions to the device.

17. The device of claim 11, wherein operation of the device comprises selection of the vibration parameter comprising at least one of a continuous vibration cycle, an intermittent vibration cycle or a frequency of vibration; and the vibration frequency is in a range of about 30 Hertz (Hz) to about 60 Hz for delayed onset muscle soreness, about 100 Hz to about 300 Hz for muscle recovery and muscle mass, and about 180 Hz to about 250 Hz for pain.

18. A device for mechanical stimulation to relieve pain or improve procedural success by improving blood flow of a user, the device comprising:

a housing having apertures extending longitudinally and a plurality of application areas comprising a convex top surface, a concave bottom surface, a front surface, a convex rear surface, convex side surfaces, rounded convex corners, and consisting of rounded protrusions only at the rounded convex corners of the housing, including a pair of front rounded protrusions and a pair of rear rounded protrusions each extending away from the concave bottom surface of the housing;

the concave bottom surface is concave both longitudinally and laterally;

each one of the pair of front rounded protrusions is laterally and longitudinally ramped vertically away from the concave bottom surface and continuously increases in height toward the rounded convex corners while wrapping around the rounded convex corners adjacent the front surface;

each one of the pair of rear rounded protrusions is laterally and longitudinally ramped vertically away from the concave bottom surface and continuously increases in height toward the rounded convex corners while wrapping around the rounded convex corners adjacent the convex rear surface;

a vibrational source in the housing and configured to produce vibration at the plurality of application areas;

a switch in operative communication with the vibrational source for controlling operation of the vibrational source;

operation of the device comprises selection of a vibration parameter comprising an amplitude of vibration, and the vibration amplitude is in a range of about 0.2 Newtons (N) to about 3.0 N; and each of the plurality of application areas is configured to perform a different technique of instrument assisted soft tissue mobilization (IASTM) on fascia of the user selected from the group consisting of a first type of IASTM comprising concentrated mechanical stimulation at myofascial trigger points procedures, a second type of IASTM comprising lymphatic drainage procedures, a third type of IASTM comprising concentrated mechanical stimulation of the body of a spasmed muscle procedures, and a fourth type of IASTM comprising activating muscle during motion procedures, reducing pain with a brace, improving range of motion and improving range of motion with the brace, wherein:

each of the rounded convex corners is configured for the first type of IASTM;

the rounded protrusions are configured for the second type of IASTM;

the convex top surface is configured for the third type of IASTM;

the concave bottom surface is configured for the fourth type of IASTM; and the convex rear surface of the device is opposite the switch and also configured for the second type of IASTM.

* * * * *